United States Patent [19]

Yamaguchi et al.

[11] 4,426,646

[45] Jan. 17, 1984

[54] SELF SHIFT TYPE GAS DISCHARGE PANEL, DRIVING SYSTEM

[75] Inventors: Hisashi Yamaguchi; Toyoshi Kawada, both of Kobe; Hirofumi Kashiwara, Kasai; Hiroyuki Ishizaki, Akashi; Kenji Murase, Kakogawa, all of Japan

[73] Assignee: Fujitsu Limited, Kawasaki, Japan

[21] Appl. No.: 217,387

[22] Filed: Dec. 17, 1980

Related U.S. Application Data

[63] Continuation of Ser. No. 12,389, Feb. 15, 1979.

[30] Foreign Application Priority Data

Feb. 16, 1978 [JP] Japan ..... 53-17199
Aug. 12, 1978 [JP] Japan ..... 53-98588

[51] Int. Cl.[3] ..... G09G 3/28
[52] U.S. Cl. ..... 340/769; 340/771; 340/798
[58] Field of Search ..... 340/768, 769, 758–759, 340/771, 798, 799

[56] References Cited

U.S. PATENT DOCUMENTS

| | | | |
|---|---|---|---|
| 3,878,430 | 4/1975 | Hirose | 340/768 |
| 3,911,422 | 10/1975 | McDowell et al. | 340/771 |
| 3,958,233 | 5/1976 | Schermerhorn | 340/768 |
| 4,125,830 | 11/1978 | Cochran et al. | 340/799 |
| 4,132,924 | 1/1979 | Yamaguchi et al. | 340/799 |

*Primary Examiner*—Marshall M. Curtis
*Attorney, Agent, or Firm*—Staas & Halsey

[57] ABSTRACT

A self shift type gas discharge panel in which the display screen comprises a plurality of shift lines arranged in parallel in the vertical direction, and a system and method for driving the panel. The display screen is divided into several sections both in the horizontal and vertical directions to form a plurality of display areas, and the shift operation can be performed independently in each of these display areas. While the forward shift operation is conducted in a single selected display area, a reciprocating or sway shift operation, or a stationary display, obtain selectively in the remaining display areas with such a configuration, so that an editing operation can be realized which is similar to that realized by the existing well known matrix display gas discharge panel. As a result, the display function can be much improved.

16 Claims, 48 Drawing Figures

FIG. 5A.

| | | |

FIG. 5C.

| | | |
|---|---|---|
| DISPLAY | A (T0) | x2 x1 x2 x1 x2 x1 x2 x1 w<br>b3 a3 d2 c2 b2 a2 d1 c1 b1 a1 w<br>y2 y1 y2 y1 y2 y1 y2 y1 |
| | D (T1) | x2 x1 x2 x1 x2 x1 x2 x1 w<br>d1<br>y2 y1 y2 y1 y2 y1 y2 y1 |
| SWAY SHIFT | D (T2) | x2 x1 x2 x1 x2 x1 x2 x1 w<br>d1<br>y2 y1 y2 y1 y2 y1 y2 y1 |
| | C (T3) | x2 x1 x2 x1 x2 x1 x2 x1 w<br>c1<br>y2 y1 y2 y1 y2 y1 y2 y1 |
| | C (T4) | x2 x1 x2 x1 x2 x1 x2 x1 w<br>c1<br>y2 y1 y2 y1 y2 y1 y2 y1 |
| | D (T5) | x2 x1 x2 x1 x2 x1 x2 x1 w<br>d1<br>y2 y1 y2 y1 y2 y1 y2 y1 |

FIG. 5D.

| | | |
|---|---|---|
| DISPLAY | A (T0) | x2 x1 x2 x1 x2 x1 x2 x1 w<br>d3 c3 b3 a3 d2 c2 b2 a2 c1 b1 a1 w<br>y2 y1 y2 y1 y2 y1 y2 y1 |
| | D (T1) | x2 x1 x2 x1 x2 x1 x2 x1 w<br>d1<br>y2 y1 y2 y1 y2 y1 y2 y1 |
| FIX | D (T2) | x2 x1 x2 x1 x2 x1 x2 x1 w<br>d1<br>y2 y1 y2 y1 y2 y1 y2 y1 |
| | D (T3) | x2 x1 x2 x1 x2 x1 x2 x1 w<br>d1<br>y2 y1 y2 y1 y2 y1 y2 y1 |
| | D (T4) | x2 x1 x2 x1 x2 x1 x2 x1 w<br>d1<br>y2 y1 y2 y1 y2 y1 y2 y1 |
| | D (T5) | x2 x1 x2 x1 x2 x1 x2 x1 w<br>d1<br>y2 y1 y2 y1 y2 y1 y2 y1 |

FIG. 7.

| MODE / STEP / BUS | DISPLAY | | | | FIRST AREA (FORWARD SHIFT) | | | | SECOND AREA (FORWARD SHIFT) | | | | ROLL UP | | | |
|---|---|---|---|---|---|---|---|---|---|---|---|---|---|---|---|---|
| | STEP | | | | STEP | | | | STEP | | | | STEP | | | |
| | 1 | 2 | 3 | 4 | 1 | 2 | 3 | 4 | 1 | 2 | 3 | 4 | 1 | 2 | 3 | 4 |
| YL 1 | 1 | 1 | 1 | 1 | 1 | 4 | 3 | 2 | 1 | 2 | 1 | 2 | 1 | 4 | 3 | 2 |
| XL 1 | 4 | 2 | 4 | 2 | 2 | 1 | 4 | 3 | 2 | 1 | 4 | 3 | 2 | 1 | 4 | 3 |
| YL 2 | 3 | 3 | 3 | 3 | 3 | 2 | 1 | 4 | 3 | 4 | 3 | 4 | 3 | 2 | 1 | 4 |
| XL 2 | 2 | 4 | 2 | 4 | 4 | 3 | 2 | 1 | 4 | 3 | 2 | 1 | 4 | 3 | 2 | 1 |
| YR 1 | 1 | 1 | 1 | 1 | 1 | 2 | 1 | 2 | 1 | 4 | 3 | 2 | 1 | 4 | 3 | 2 |
| XU 1 | 4 | 2 | 4 | 2 | 4 | 3 | 4 | 3 | 4 | 3 | 4 | 3 | 2 | 1 | 4 | 3 |
| YR 2 | 3 | 3 | 3 | 3 | 3 | 4 | 3 | 4 | 3 | 2 | 1 | 4 | 3 | 2 | 1 | 4 |
| XU 2 | 2 | 4 | 2 | 4 | 2 | 1 | 2 | 1 | 2 | 1 | 2 | 1 | 4 | 3 | 2 | 1 |

FIG. 9A.
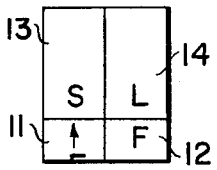
FIG. 9B.
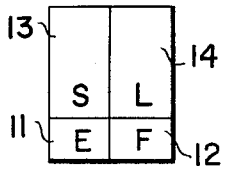
FIG. 9C.
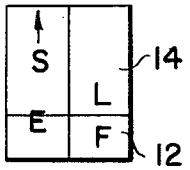
FIG. 9D.
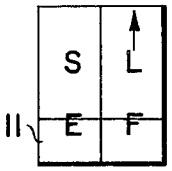
FIG. 9E.
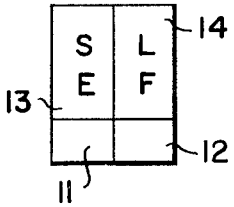
FIG. 11.
| BUS \ MODE STEP | ROLL UP (LEFT SCREEN) STEP 1 | 2 | 3 | 4 | ROLL UP (RIGHT SCREEN) STEP 1 | 2 | 3 | 4 |
|---|---|---|---|---|---|---|---|---|
| YL 1 | 2 | 1 | 4 | 3 | 2 | 1 | 2 | 1 |
| XL 1 | 3 | 2 | 1 | 4 | 3 | 2 | 1 | 4 |
| YL 2 | 4 | 3 | 2 | 1 | 4 | 3 | 4 | 3 |
| XL 2 | 1 | 4 | 3 | 2 | 1 | 4 | 3 | 2 |
| YR 1 | 2 | 1 | 2 | 1 | 2 | 1 | 4 | 3 |
| XU 1 | 3 | 2 | 1 | 4 | 3 | 2 | 1 | 4 |
| YR 2 | 4 | 3 | 4 | 3 | 4 | 3 | 2 | 1 |
| XU 2 | 1 | 4 | 3 | 2 | 1 | 4 | 3 | 2 |

t11
t12
t13
t14
t15
SP
EP
ai
(XL1-YR1)
bi
(XL1-YR2)
ci
(XL2-YR2)
di
(XL2-YR1)

YL1
XU1
YL2
XU2 ai
(XU1-YL1)
bi
(XU1-YL2)
ci
(XU2-YL2)
di
(XU2-YL1)

YR1
XU1
YR2
XU2 ai
(XU1-YR1)
bi
(XU1-YR2)
ci
(XU2-YR2)
di
(XU2-YR1)

SELF SHIFT TYPE GAS DISCHARGE PANEL, DRIVING SYSTEM

This is a continuation, of application Ser. No. 12,389 filed Feb. 15, 1979.

BACKGROUND OF THE INVENTION

1. Field of the Invention

The present invention relates to a new type of AC driven self shift gas discharge panel, and to a system and method for driving it, wherein the display screen is divided into several sections both in the horizontal and vertical directions, and the write and shift operations can be made independently in respective ones of the divided display areas, and which allows various improvements in the display function.

2. Description of the Prior Art

As an existing display device utilizing gas discharge, the AC driven type of gas discharge panel is well known. However, since this panel uses matrix addressing, it requires many drivers for operation, and the necessary drivers and related electronic circuitry become very expensive. The self shift type gas discharge panel of the present invention solves such disadvantages of the matrix addressing system.

Basically, a self shift type gas discharge panel has shift channels defined by a regular arrangement of groups of discharge cells, each group being driven by a voltage with a particular phase. Such a panel is driven so that the discharge spots, that are generated when a write voltage is applied to the write discharge cells provided at one end of the shift channels, are sequentially shifted by making use of the coupling effect between adjacent cells. Well known self shift type gas discharge panels of this kind, for example, are (1) those employing a matrix electrode configuration as disclosed in U.S. Pat. No. 3,994,875 by Owaki et al. and assigned to the same assignee as the present invention, (2) those employing a parallel electrode configuration as disclosed in U.S. Pat. No. 3,775,764 by J. P. Gaur, and (3) those employing a meander electrode arrangement or the meander channel configuration as disclosed in U.S. Pat. Nos. 4,185,229 and 4,190,778 of Yoshikawa et al. and also assigned to the same assignee as the present invention.

These self shift panels have the advantage that the number of drivers for the electrodes of the X and Y sides is drastically reduced over that in the matrix address system, since only three or four shift drivers are required. However, such existing self shift type gas discharge panels have the following disadvantages when used for various kinds of monitor and keyboard display with computer terminals. Character information written in character units at one edge of the shift line is shifted horizontally and then is fixed for display at a specified display position. Thus, the panel has a configuration which does not allow random addressing, and therefore the character information to be displayed in one shift line cannot be individually written. Therefore, the aforementioned display panels cannot realize a write operation function in which character information previously written by write command signals sent from a computer is held at a predetermined display position while different information is written into a specified display position of the same shift line, by successive keyboard operation under this holding condition.

SUMMARY OF THE INVENTION

An object of the present invention is a novel self shift type gas discharge panel for improving the display modes and panel operability, and for increasing the number of display functions to meet the requirements of various terminal displays. Other objects are a driving system for, and a method of operating, the panel.

A further object of the present invention is a self shift type gas discharge panel which enables a type of random address display as in the case of the ordinary matrix display type gas discharge panel, and as well a driving system for, and a method of operating, the panel.

Yet another object of the present invention is to offer a self shift type gas discharge panel that enables concurrent writing of a first set of data while a second set of data is displayed, by using a write drive circuit and a driving system according to the present invention.

This invention is characterized in that a self shift type gas discharge panel has a display screen divided into several areas in both the vertical and horizontal directions to enable selective partial shift operations in each area of the several divided display areas.

In order to attain information input and display for each display area by the shift operation, the present invention employs a new configuration of a self shift type gas discharge panel. The display screen has a plurality of parallel shift channels, each comprising a periodic arrangement of discharge cells of plural groups, the discharge cells being defined by periodically arranged electrodes.

In one embodiment, the display screen is divided in the horizontal and vertical directions into four areas, each of which includes an arrangement of many discharge cells, and the electrodes defining the shift channels extend in common to each adjacent pair of display areas in both the vertical and horizontal directions. The write electrodes which define the write discharge cells are respectively provided at least at one end of each shift channel.

The present invention involves a new driving system that allows the following operation. Two display areas divided by a vertical line, each having respective write discharge cells along its bottom edge, may be respectively considered as the 1st and 2nd display areas, while two other display areas respectively adjacent to the upper side of the 1st and 2nd display areas may be considered as the 3rd and 4th display areas. Shift drive circuits supply different shift voltages to electrodes extending into adjacent display areas in both the vertical and horizontal directions.

The shift operation in each display area is individually controlled in certain respects. A write drive circuit is connected to write electrodes located at one end of each of the shift channels, with selected groups of these write electrodes being commonly connected to the write drive circuit. While the write operation for a selected first display area and the subsequent shift operations are performed, the information displayed in the half-selected 2nd and 3rd display areas is sustained by reciprocation, which is a repetition of the forward and backward shift operations which result in what is called a sway shift operation for the display spots in these areas, within a predetermined spatial cell arrangement period. Simultaneously, information is displayed in the non-selected 4th display area by being sustained in the sway shift or in a stationary display mode.

According to the present invention, a new drive system is employed in a self shift type gas discharge panel having the display screen divided into plural sections and the write drive circuits connected in common to the write discharge cells. Character data in units of picture elements to be written into these display areas is input alternately and selectively to the write circuit for writing this character data in each of the display areas.

The shift operation for each of the display areas is alternately and selectively performed in synchronization with this write operation. The discharge spots generated by the corresponding write discharge cells are shifted forward in the selected display area, and the discharge spots corresponding to the same character data which are generated simultaneously at the commonly connected write discharge cells corresponding to the non-selected remaining display areas are shifted in the backward direction to be effectively erased. In the present invention, the term "vertical direction" means a direction perpendicular to the line of the write electrodes, which may in fact be either horizontal or vertical.

In the present invention, "data" means any display data including the usual alphabetic characters, numbers, symbols, etc. Furthermore, the sway shift operation across an entire panel is described in detail in U.S. Pat. No. 4,190,789, issued Feb. 26, 1980, by Kashiwara et al. which is assigned to the same assignee as the present application.

Other objects and features of the present invention will be more clearly understood from the explanation of the preferred embodiments in reference to the drawings.

BRIEF DESCRIPTION OF THE DRAWINGS

FIGS. 5A to D show the shift operations for the discharge spots in each display area of the panel shown in FIG. 1.

FIG. 7 is a chart showing one example of combinations of basic pulse trains which are applied in sequence to the electrode terminals of the display area to provide the operating modes of the present invention.

FIGS. 9A to E show an example of the data writing sequence in accordance with the configuration of FIG. 8.

FIG. 11 is a chart showing an example of the combinations of basic pulse trains which are applied in steps to the electrode terminals of the display area in the roll up operation mode in accordance with one embodiment of the present invention.

DESCRIPTION OF THE PREFERRED EMBODIMENTS

Figure 1:
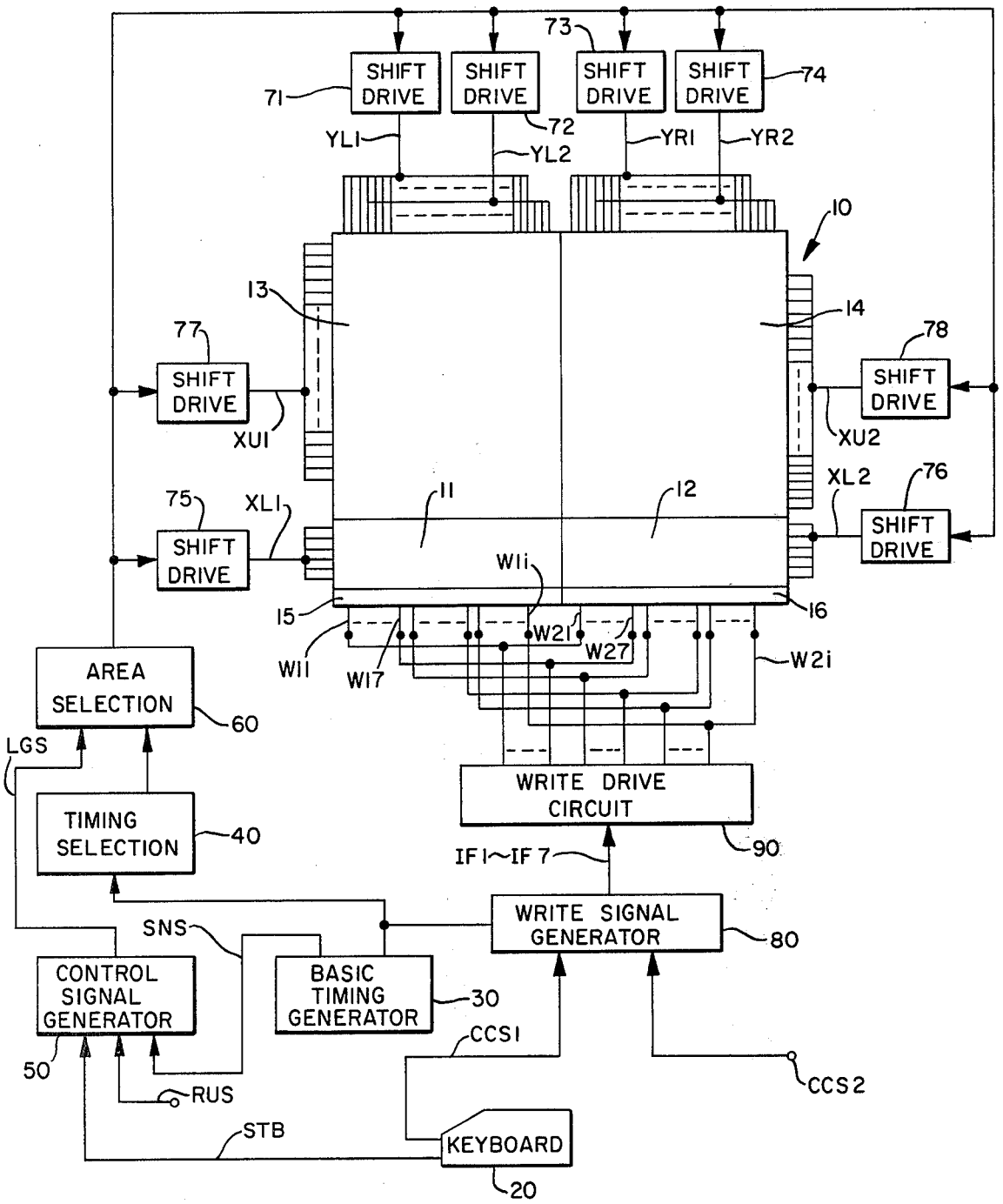
FIG. 1 shows a block diagram of an embodiment of the self shift type gas discharge panel, and a system for driving it, in accordance with the present invention.

In FIG. 1, the display screen of a self shift type gas discharge panel (hereinafter referred to as a self shift PDP) is divided, for example, into four areas in the vertical and horizontal directions, providing 1st, 2nd, 3rd and 4th display areas 11, 12, 13 and 14, and each of these display areas may have a meander electrode arrangement of $2\times2$ phases which will be described later. Thus, the plurality of vertically oriented shift channels which are defined by the electrode arrangement extend to cross each pair of combined display areas 11, 13 and 12, 14. Two Y electrode groups for each of these pairs of areas are separately supplied by the common terminals YL1, YL2, and YR1, YR2 for the 1st and 3rd and the 2nd and 4th display areas, respectively. The two pairs of X electrode groups are respectively supplied by the common terminals XL1, XL2 and XU1, XU2 for the 1st and 2nd and the 3rd and 4th display areas, respectively. The 1st and 2nd display areas 11, 12, located in this embodiment in the lower part of the panel, have at least one row of data display so that these 1st and 2nd display areas may be used as a monitor row. Underneath this monitor row the row of write discharge cells 15, 16, comprising one for each shift channel, are provided with write electrode terminals W1i, W2i . . . W7i (i is 1,2, . . . ). The upper display areas 13 and 14 comprise the display rows.

In order to realize a particular shift operation in each display area of the self shift PDP 10, the keyboard 20, the basic timing signal generator circuit 30, the timing selection circuit 40, the control signal generator circuit 50, the area selection circuit 60, the shift drive circuits 71 to 78, the write signal generator circuit 80 and the write drive circuit 90 are connected to the PDP 10 as shown in FIG. 1. These circuits will be described in detail later, and only a brief explanation is given next.

First, the keyboard 20 generates the character code signal CCS1 corresponding to character data to be written and also the write command signal STB, in reply to the keyboard operator's instructions. The basic timing signal generator circuit 30 generates four basic pulse trains to be combined for shift and write operations in the different display areas and also a signal SNS to indicate the number of times a shift operation has been repeated. The timing selection circuit 40 outputs to the respective shift drivers 71 to 78 the necessary waveforms for the write-shaft operation, the sway shift operation and the stationary or fixed display operation for each display area, each as a composite signal of said four basic pulse trains, in the proper distribution sequence for these operations. When character data is keyed in, the control signal generator circuit 50 enables the writing and shifting of the data, in response to the write command signal STB and the signal SNS. It generates a logic signal LGS which depends on an area selection command signal ESS (shown only in FIG. 6) and the roll up command signal RUS.

The area selection circuit 60 selects, in response to input from the logic signal LGS, the basic pulse trains arranged in a predetermined distribution sequence and supplies them to the shift drive circuits 71 to 78, to cause the various shift and display operations in the display areas 11 to 14, including selective roll up operations from the 1st to the 3rd and from the 2nd to the 4th display areas. The shift drive circuits 71 to 74, and 75 to 78 are provided corresponding to the eight electrode terminals YL1, YL2, YR1, YR2 and XL1, XL2, XU1, XU2 along the Y and X sides of the self shift PDP 10. These shift drive circuits generate the shift voltage pulses SP in response to the basic pulse trains.

The write signal generator circuit 80 receives the character code signal CCS1 sent from the keyboard 20, or the character code signal CCS2 from an external computer, and sequentially generates an appropriate (for instance, 7×9) dot pattern for representing characters, with each dot corresponding to one picture element, for the write signals IF1 to IF7. Each output of the write drive circuit 90 is connected in common to two write electrodes of the respective groups W1i and W2i (i=1,2 . . . ) as shown also in FIG. 3 with i-1, 2, and generates the write voltage VW for each pair of common electrodes in accordance with the character pattern signals from the driver 90.

Figure 2A:
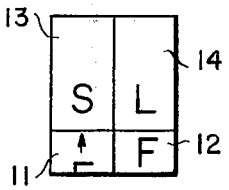
FIGS. 2A to D show an example of the data writing sequence in accordance with the embodiment of FIG. 1.

In this configuration, for example, the character "E" may be keyed in from the keyboard 20 under the condition that the 1st display area 11 is selected by the logic signal LGS sent from the control signal generator circuit 50. FIG. 2 shows a typical write operation sequence for a panel with a monitor rows portion of 1 row and 2 characters and a display portion of 2 rows and 4 characters as shown. When a character "E" is keyed in, the relevant area is put into the vertical shift operation mode by being driven by the Y side shift drive circuits 71, 72 and the X side shift drive circuits 75, 76 corresponding to the 1st display area 11 which was previously selected by the area selection circuit 60. Seven write electrodes W11 to W17 corresponding to the 7 shift channels of the single character of the area 11 are sequentially selected 9 times in synchronization with the shift operation and thereby the character "E" is written into the panel with a 7×9 dot pattern as shown in FIGS. 2A and B.

At this time, the 2nd display area 12 which has the X side electrode terminals in common with the 1st display area 11, and the 3rd display area 13 which has the Y side electrode terminals in common with the 1st display area 11 are set in the half-selected condition by the signal input, and the basic pulse trains with a distribution sequence different from that for the shift operation are supplied to the other Y side and X side electrode terminals, respectively. Therefore, the characters "F" and "S" which were initially displayed in these display areas 12 and 13 are sustained as shown in FIGS. 2A and B by repetition of the sway shift operation. In the not-selected 4th display area 14, since the respective Y and X side electrode terminals are connected in common with the 2nd and 3rd display areas 12 and 13, the shift voltages are continuously applied to the corresponding particular electrode groups so that the character "L" which was displayed previously in this display area 14 is sustained in a stationary display condition as shown in FIGS. 2A and B.

Figure 2C:
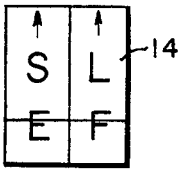
Figure 2B:
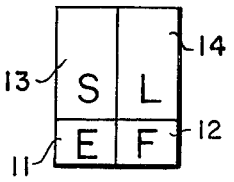
Figure 2D:
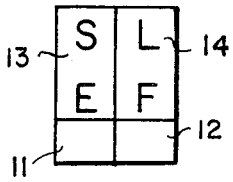

Then, when the roll up command signal RUS is input to the control signal generator circuit 50, in order to roll the characters "E" and "F" written in the lower display areas 11 and 12 of the monitor row up into the upper display areas 13 and 14, the logic signal LGS indicating said command is output from the generator circuit 50 and is supplied to the area selection circuit 60. Thus, the area selection circuit 60 drives all the shift drive circuits 71 to 78 and sets all the display areas 11 to 14 in the vertical shift operation mode. As a result, the characters "E", "F", "S", and "L" are shifted upward one character. Therefore, the characters "E" and "F" in the lower display areas 11, 12 are rolled up into the upper display areas 13, 14, and in the 3rd and 4th display areas 13, 14 the characters "S", "E" and "L", "F" are vertically displayed, respectively, as shown in FIGS. 2C and D.

Figure 3:
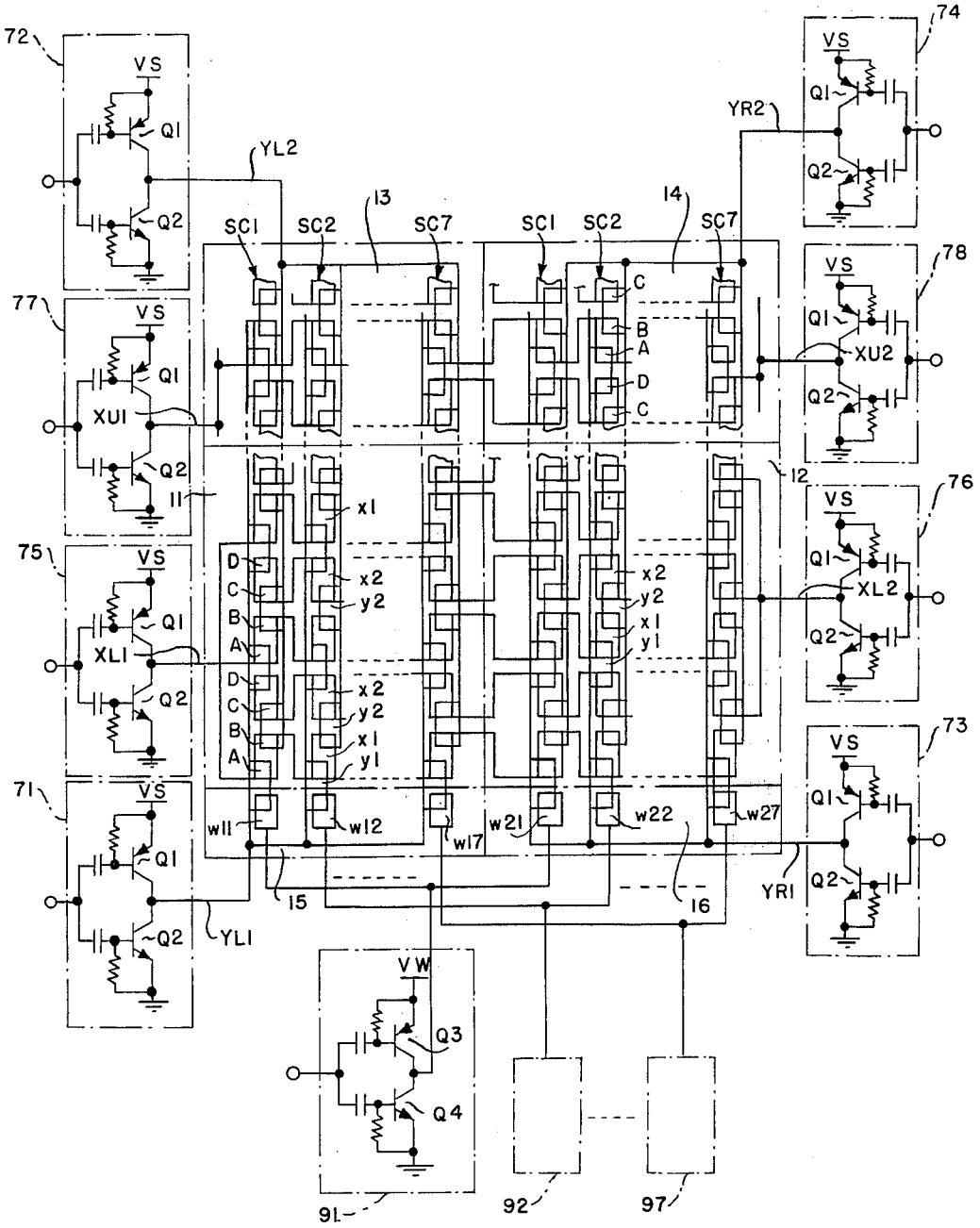
FIG. 3 shows the electrode configuration of the self shift type gas discharge panel, in accordance with an embodiment of the present invention, and a circuit for driving it.

FIG. 3 shows in more detail the electrode arrangement of the self-shift PDP and an example of the circuit for driving it. Of course, the self shift PDP is not limited to the electrode arrangement shown in this figure, for example, it could comprise meander patterned electrodes. In FIG. 3, the self shift PDP 10 provides plural lines of two groups of shift electrodes y1 and y2 which are alternately arranged vertically on one substrate, and plural lines of two groups of shift electrodes x1 and x2 which are also alternately arranged vertically for each shift channel on the other substrate. These electrodes on both substrates are respectively coated by a dielectric layer.

Thus, in the discharge gas filled space between the four groups of opposing electrodes y1, y2 and x1, x2, groups of the 4-phased discharge cells A to D are formed uniformly and periodically in accordance with the arrangement sequence of the electrodes. A plurality of character display lines are thereby formed as shown in FIG. 3, where seven (7) shift channels SC1 to SC7 oriented in the vertical direction are formed for each character along the respective column lines of electrodes. Each picture element is formed by four discharge cells A to D. At the lower end of the shift channels SC1 to SC7, the write electrodes w11 to w17, . . . wn1 to wn7 (n is an integer) are provided as explained above across the discharge gap from the first shift electrode y1, and the four shift electrode groups y1, y2, and x1, x2 are extended and correspondingly connected to the terminals YL1, YL2, YRL, YR2, XL1, XL2, XU1, XU2 respectively via the buses as shown in FIG. 3 in the above mentioned 1st, 2nd, 3rd and 4th display areas 11 to 14.

Each of the shift drive circuits 71 to 78 have a pair of transistors Q1 and Q2 as the shift pulser connected in series between the shift voltage source Vs and ground, and each shift drive circuit is connected to a corresponding shift electrode terminal. The write drivers 91 to 97 are connected respectively to the write electrodes w11 to w17, . . . , wn1 to wn7, each of these comprising a pair of transistors Q3 and Q4 as the write pulser connected in series between the write voltage source Vw and ground.

Figure 4G:
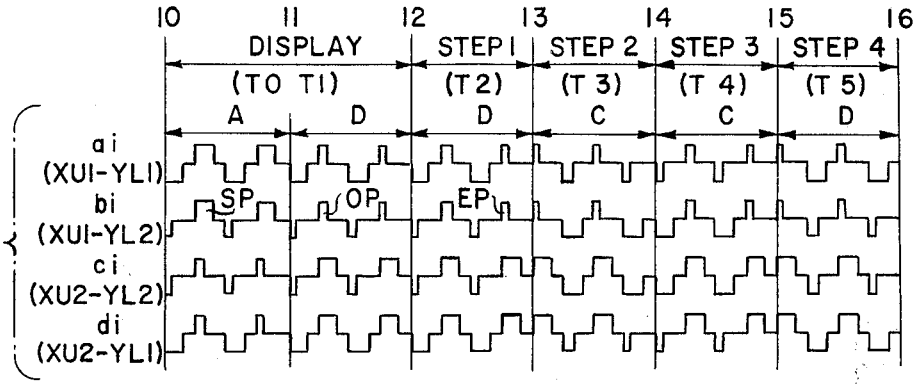
FIGS. 4A to H show an example of the driving voltage waveforms for the driving circuit shown in FIG. 3.
Figure 4H:
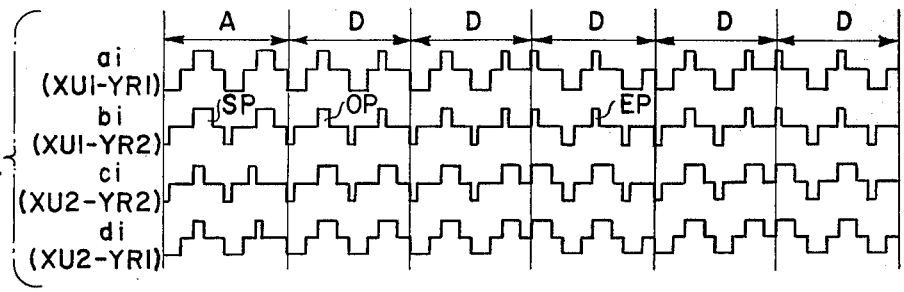
Figure 4A:
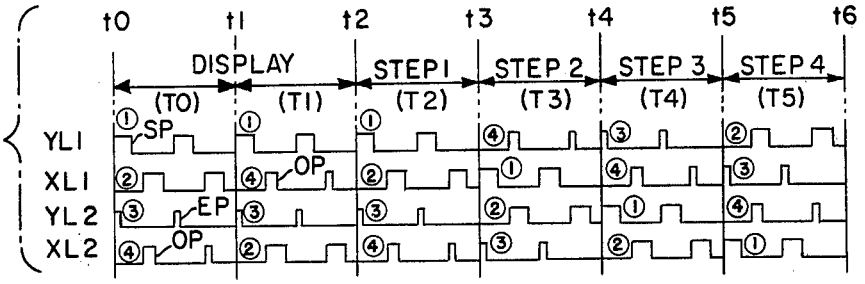
Figure 4B:
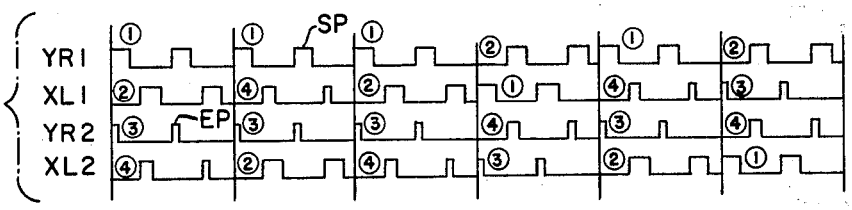

FIGS. 4A to H show an example of the drive voltage waveforms, for the panel identified above with the display areas 11 to 14. Here the 1st display area 11 is selected for receiving new data while changing the operation mode from the display mode to the shift operation mode, while the 2nd and 3rd display areas 12 and 13 are placed in the half-selected condition and the 4th display area 14 is placed in the not-selected condition. FIGS. 4A, B, C and D, respectively, show the electrode voltage waveforms applied to each electrode of the selected, half-selected and not-selected display areas through the noted electrode terminals, and FIGS. 4E, F, G and H are the resulting voltage waveforms across the respective cells. The write voltage waveform which is applied to the write electrodes for the write operation is omitted here.

As FIGS. 4A through H indicate, the display areas 11 to 14 are set in the display mode during the period from t0 to t2. During the first unit period or step T0, the overlap pulse OP is applied to activate the discharge cells of phase A and the shift pulse SP is output from the shift drive circuits. During the unit period T1, these two pulses are also output from corresponding shift drive circuits to activate the discharge cells of phase D. During these periods a narrow erase pulse EP is applied to the discharge cells of phase B and phase C which do not require activation. As a result, the discharge spots are sustained by swaying between the discharge cells of phase A and phase D. This swaying operation is continually repeated during the display mode.

FIGS. 5A through D show the shift operation of a discharge spot in a typical shift channel of the display areas resulting from the cell voltage waveforms shown in FIGS. 4A through H. In the display mode, the unit periods T0, T1 are repeated and the discharge spots are reciprocally shifted or swayed in the sequence of discharge cells a2 to d1 to a2 to d1 . . . as shown for the unit periods T0 and T1 in FIG. 5A. In this figure, the shift channel is shown horizontally.

For the forward shift operation in the 1st display area 11, four basic pulse trains (1) to (4) are applied sequentially during the four unit periods T2, T3, T4, T5 to the four electrodes of the seven shift channels of the relevant display area via the bus terminals YL1, YL2, XL1, and XL2, as shown in FIG. 4A. The discharge spot being held at the discharge cell d1 is then shifted in the sequence of a2 to b2 to c2 to d2 . . . , as shown in FIG. 5A. During this shift operation, the write pulse (not illustrated) is selectively applied to the write electrode selected in every period T5 when the discharge cells of phase D are activated, so that desired data is written at this time. Also, the erase pulse EP is applied to the discharge cell from which the discharge spot is shifted to prevent further discharge at that cell until the next cycle.

While the above-mentioned shift operation is being conducted in the selected 1st display area 11, the sway shift operation as explained previously is conducted as explained below at the two half-selected display areas 12,13. In the 2nd display area 12, the X side electrode groups of each shift channel are extended to the terminals XL1, XL2 in common with the X side electrode groups of the 1st display area 11, and the same respective pulse trains for every unit period are applied thereto as in the 1st display area. On the other hand, the pulse trains for every unit period applied to the two Y side electrode groups via the terminals YR1, YR2 are different from those in the 1st display area. More specifically, as is clear from FIGS. 4A, B, E and F, the application in period T3 of the basic unit pulse trains (4) and (2) is followed by pulse trains (3) and (1) in period T4 for the Y electrode groups.

Therefore, in the 1st step T2 of the shift operation, a forward shift occurs in the 2nd display area as in the case of the 1st display area (d1 to a2), but in the 2nd step T3, since the shift pulse SP is in the reverse phase to that applied in the 1st step $T_1$ to the Y and X electrodes YR 1 and XL 1, the discharge spot in the 2nd display area maintained at the cell group ai of the phase A. In the 3rd step T4 of the shift operation, since the pulse train which is similar to that for the unit period T1 of said display mode is applied to each electrode of the 2nd display area, the discharge spot is shifted backward from the discharge cell group a1 of phase A to the initial discharge cell group di of phase D. FIG. 53 shows the shift operation in the 2nd display area, where the discharge spot is subject to the sway shift in the sequence of d1 to a2—a2 to d1, etc.

Figure 4C:
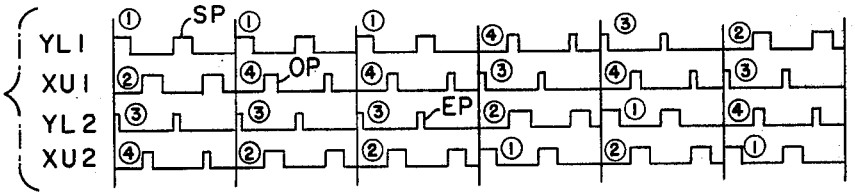

In the 3rd display area 13, as shown in FIGS. 4C, 4G and 5C, when supplying the pulses to the upper X terminals XU1, XU2 which also extend into the 4th display area 14, the pulse trains (2) and (4) are replaced by pulse trains (1) and (3) when changing between the 1st step T2 to the 2nd step T3 of the sway shift operation.

Therefore, in these steps, the shift operation which is similar to that conducted for the 2nd display area 12 is conducted, and as a whole each discharge spot is subject to the sway shift in the sequence of d1—d1 to c1—c1 to d1. Thus, the discharge spot in the half-selected display area is sustained in the vibrating or reciprocating mode in the 2-group 2-phase spatial discharge cell arrangement period by means of the sway shift operation.

Figure 4D:
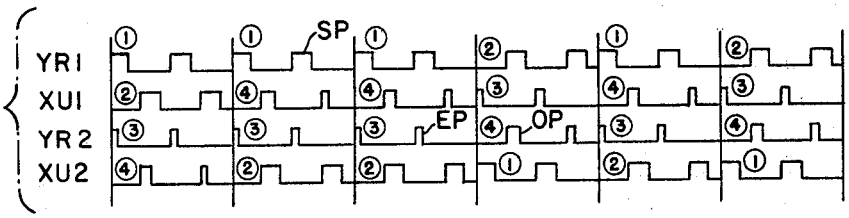
Figure 4E:
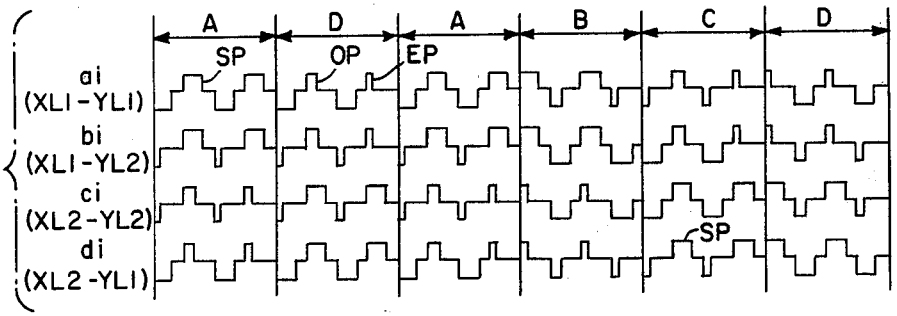
Figure 4F:
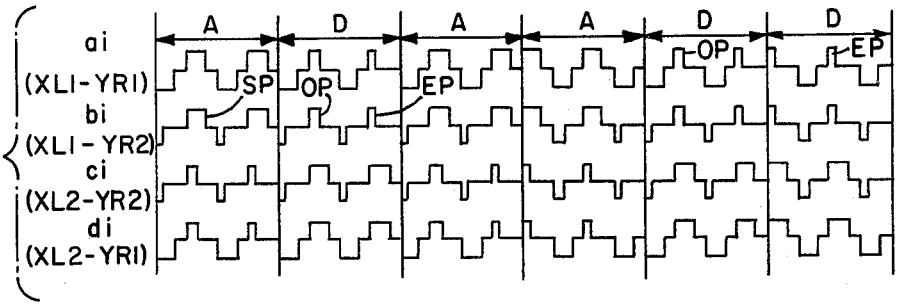

While the shift operation is being performed for the 1st display area 11, a stationary display is conducted as explained below in the not-selected 4th display area 14, as shown in FIGS. 4D, 4H and 5D. The Y and X side electrode groups which form the shift channels of the 4th display area 14 are connected to the terminals YR1, YR2 and XU1, XU2 in common with the Y electrode groups of the 2nd display area 12 and the X side electrode groups of the 3rd display area 13. The shift pulse SP is applied only to the Y side and X side electrodes YR1 and XU2 in each unit period of the stationary display (T2 to T5) and therefore the discharge spots are held in the discharge cell groups of the D phase and the so-called stationary display condition is obtained.

As explained above, according to the present invention, display information in the half-selected display area is sustained by the sway shift operation within the specified spatial discharge cell arrangement period, while the ordinary forward shift operation is conducted in the selected display area, and simultaneously the information in the not-selected display area is sustained in the stationary display condition in the specified spatial cell arrangement.

Figure 6:
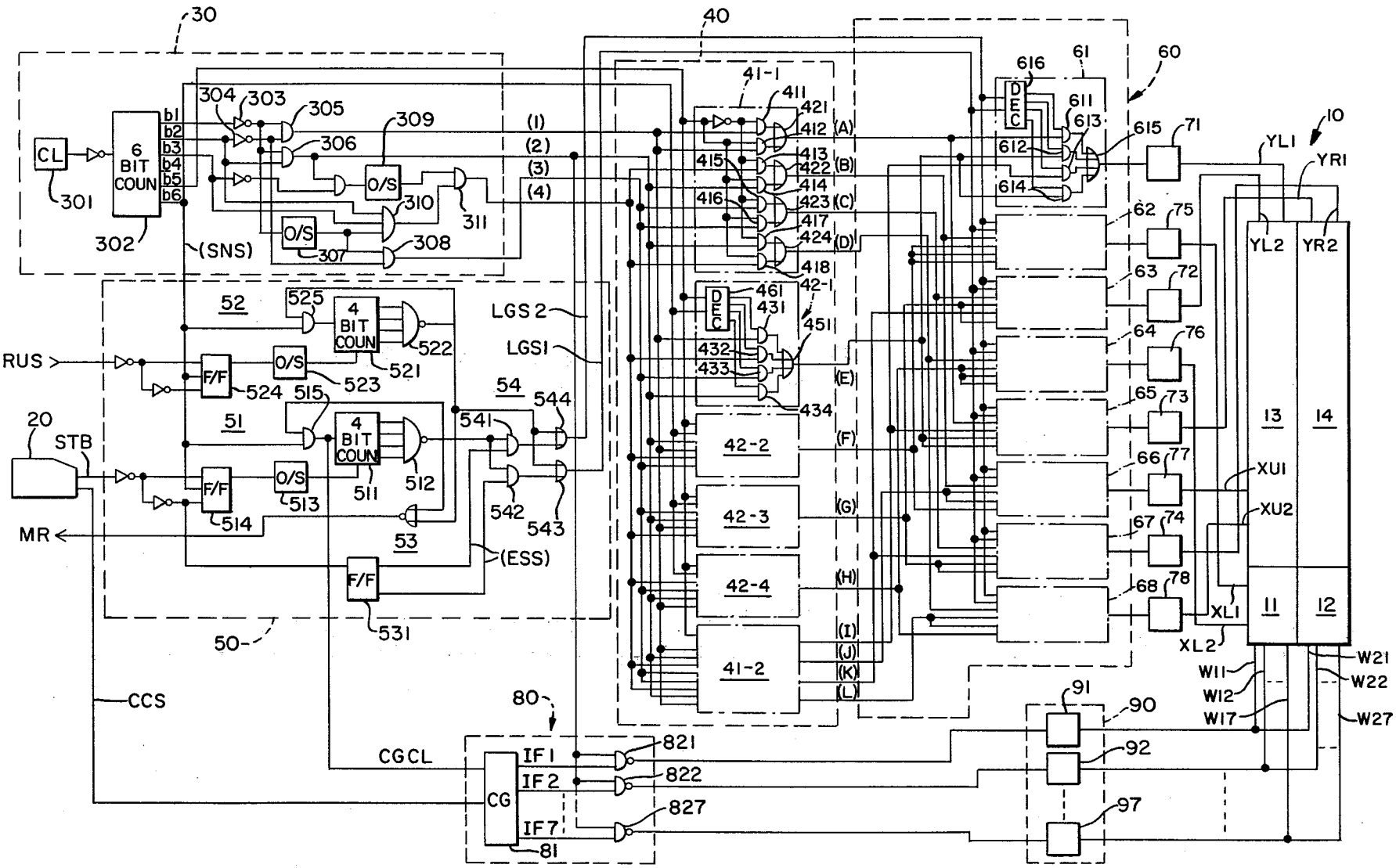
FIG. 6 shows an embodiment of the driving circuit in accordance with the present invention.

FIG. 6 shows a block diagram of another embodiment of the driving circuit for selective data write, shift and sustain operations in each display area of the above-mentioned self shift PDP. In this figure, the basic timing signal generator circuit 30, which controls the timing of the generation of the four basic pulse trains (1), (2), (3), and (4) mentioned above, comprises the binary 6-bit counter 302 which counts the clock pulses sent from the clock pulse generator 301, and an inverted output of this counter is output from the 1st and 2nd bit inverters 303 and 304 to the AND gate 305. This gate 305 outputs the 1st timing signal corresponding to the above-mentioned basic pulse train (1), including the shift pulse SP to the conductor line (1) with every four counts of the clock pulses. The inverted output of the 1st and 2nd bit outputs are input to the AND gate 306 and the 2nd timing signal corresponding to the above-mentioned basic pulse train (2) including the shift pulse SP is output to the line (2).

The inverted output of the 1st bit is input to the monostable circuit 307 to generate the erase pulse EP, and the inverted output of the 2nd bit is input to the AND gate 308 and thereby the 3rd timing signal corresponding to the above-mentioned pulse train (3) is output to the line (3). The logic AND output of the inverted output of the 3rd bit and the output of said AND gate 306 is input to the monostable circuit 309 to generate the overlap pulse OP, and then the erase pulse EP obtained by the monostable circuit 307 is input to the AND gate 310, which gate 310 is opened by the input of the 2nd and 3rd bit outputs, and these overlap and erase pulses are then input to the OR gate 311, to output the 4th timing signal corresponding to the above-mentioned basic pulse train (4) to the line (4). In addition, as described above, this generator circuit 30 outputs the signal indicating the number of times the shift operation has been applied, as explained below.

Namely, in the case of the self shift PDP having the meander electrode configuration as shown in FIG. 3, since the discharge cells of 4-groups corresponding to 4-phases are periodically arranged, the 4 unit periods form one cycle of the shift operation and a new unit period begins with every 16 counts of the clock pulses. Therefore, the 6th bit output of the 6-bit counter 302, corresponding to 64 counts of the clock pulses, corresponds to the signal (SNS) which indicates the end of one cycle of shift operation.

The control signal generator circuit 50 is composed of the ordinary write and shift control command circuit 51, the roll-up control command circuit 52, the area selection command circuit 53, and the operation change-over control circuit 54. The ordinary write shift control circuit 51 issues a command to write the character data keyed in from the keyboard 20 to the lower display areas or monitor rows 11 and 12. The roll-up control command circuit 52 issues a command to roll up the data displayed in the display areas 11 and 12 to the upper display areas or display rows 13 and 14. All of these command circuits are generally quite similar.

For the embodiment under consideration, each character pattern or fount comprises a pattern of $7\times9$ dots as described previously, and 7 dots of vertical spacing between characters is also provided. Therefore, whenever $16(9+7)=256$ clock pulses in the shift cycle operation occurs, a new timing signal for character writing appears. Specifically, the circuit comprises (1) the 4-bit counters 511 and 521 which are reset to the initial condition each time the shift operation number signal SNS counts up to 16, (2) NAND gates 512 the 522 which output and shift operation command output "1" until the counters are reset to the initial condition in respose to the outputs of the counters, (3) monostable circuits 513 and 523 which output the reset signal for resetting said counter to the initial condition, (4) the flip-flop circuits 514 and 524 which control the monostable circuits 513, 523 in response to the above-mentioned write command signal STB and the roll up command signal RUS which are output selectively, and (5) AND gates 515 and 525 which supply said signal SNS to the counters 511 and 521 for every cycle of shift operation. The command signals STB and RUS maintain the logic output "L" during the time when data of one character including the above specified inter-character space is written.

The area selection command circuit 53 issues a command for selecting an ordinary write or shift operation in the 1st display area 11 and the 2nd display area 12. In the embodiment of FIG. 6, the area selection occurs alternately each time the write command signal STB is input. For this purpose, the circuit is composed of the flip-flop 531 whichalternately switches the two output conditions with the command signal input. The operation of the change-over control circuit 54 controls the change-over of the ordinary shift operation and the roll up operation for the display areas selected in response to the command signal sent from the command circuit 53. This circuit comprises a pair of AND gates 541 and 542 which individually open the gates with each output of the flip-flop 531 to pass the output of the NAND gate 512, namely the ordinary shift operation command output. When the AND gate 541 generates logic output "1", the 1st display area 11 is selected, and when the AND gate 542 generates logic output "1", the 2nd display area 12 is selected. This control circuit includes a pair of OR gates 543 and 544 which controls the passing of the ordinary shift operation command output which has passed the AND gate and the shift command output for roll up and output of the logic signals LGS1, LGS2. In the embodiment of FIG. 6, the roll up operations for the left display area and right display area are performed simultaneously.

The timing selection circuit 40 has two circuit blocks 41-1, 41-2 each of which is composed of four pairs of AND gate pairs 411–412, 413–414, 415–416, 417–418, and OR gates 421, 422, 423, 424 connected at the output side of each pair of the AND gates. One of each of the AND gate pairs, namely the AND gates 411, 413, 415, 417 receive the inverted 5th bit output of the above-mentioned 6-bit counter 302 as one input, while the other one of each of the AND gate pairs 412, 414, 416, 418 receive the 5th bit output of the counter 302 as one input. As the other input of these AND gates, the above-mentioned basic pulse trains (1) to (4) are coupled in the relation shown in FIG. 6. In short, these circuit blocks output by respectively switching two kinds of basic pulse trains from the output conductor lines (A) to (D) and (I) to (L) in accordance with the 5th bit output, namely it outputs these pulses by alternately switching them for each unit period. In addition, this selection circuit 40 has four circuit blocks 42-1, 42-2, 42-3 and 42-4, the first of which is typical and shown in FIG. 6 to comprise four AND gates 431 to 434, the OR gate 451 and the 4-line decoder 461 which decodes the outputs of the 5th and 6th bits. Connected as one input of these AND gates are the four outputs of the decoder 461, while the other inputs are the four basic pulse trains coupled as shown in FIG. 6. In short, these circuit blocks are provided for outputting the pulse trains one by one to the conductor lines (E) and (H) in a predetermined distribution sequence according to the values of the 5th and 6th bit outputs of counter 302.

The area selection circuit 60, in the embodiment of FIG. 6, has the function of selecting the four display areas. This circuit is composed of eight circuit blocks 61 to 68 which are inserted between the output conductor lines (A) to (L) of the timing selection circuit 40 and the eight shift drive circuits 71 to 78. These circuit blocks have the same circuit configuration except for the inputs from the output conductor lines (A) to (L). Circuit 61 is typical of these, and comprises AND gates 611 to 614, the OR gate 615 and the 4-line decoder 616 for decoding logic signals LGS1, LGS2 sent from said control signal generator circuit 50. One set of input to the AND gates are the respective four outputs of the decoder, while the other inputs are the respective outputs from the timing selection circuit (A) to (L). The output of each OR gate, each of which gates the outputs from the AND gates, is connected to the respective one of the circuits 71 to 78.

The write signal generator circuit 80 comprises the character generator 81 which sequentially outputs 7-dots at a time on the lines IF1 to IF7 the character pattern signals of 7×9 dots in response to the character code signal CCS. One set of seven dots is output for every cycle of operation comprising 4 unit periods. The NAND gates 821 to 827 which ensure matching these outputs with the basic pulse train 2 which indicates the write timing.

FIG. 7 shows an example of the four step combinations of the basic pulse trains for application to the electrode terminals of the display areas in each operation mode. Operation of a circuit with such waveforms is explained next in accordance with the circuit shown in FIG. 6.

First, for the display mode, the logic signals LGS1, LGS2 that are output from the control signal generator circuit 50 are all "0" and therefore the decoder (616, for example) in the circuit blocks 61 to 68 of the area selection circuit 60 outputs the first bit at the level "1". Thus, each corresponding AND gate (611, for example) is opened, allowing the four basic pulse trains sent from the circuit blocks of the timing selection circuit 40 to pass in parallel in each step with the relation as shown in FIG. 7. The basic pulse trains having passed these AND gates are sent to the corresponding OR gates (615, for example) and then supplied in parallel to the shift drive circuits. As a result, in each display area the discharge spot is sustained by the sway shift operation between the discharge cells of phase D and A in accordance with the distribution sequence of the basic pulses in each step.

It it is required here to allow the usual forward shift operation only in the 1st display area 11, the logic signal LGS1 becomes "1", while LGS2 becomes "0" on the basis of the output from the flip-flop 531 in response to the write command signal STB issued when data is keyed in, and thereby the 2nd bit output of the decoders (616, for example) become "1". Thus, corresponding AND gates (612, for example) open the gates, passing in parallel in each step the basic pulse trains output from all the circuit blocks 41-1, 41-2 and 42-1 to 42-4 of the timing selection circuit 40 as shown in FIG. 7. Thereafter, these pulses pass the OR gates (615, for example) and then they are applied to the corresponding shift driver. As a result, as is clear from the electrode voltage waveform of FIG. 4, in the 1st display area 11 the discharge spot which is written by the activation timing of phase D is shifted in the sequence of D to A to B to C to D, while a discharge spot in the 2nd display area 12 is sway shifted in the sequence of D to A—A to D—D, a discharge spot in the 3rd display area 12 is sway shifted in the sequence of D—D to C—C to D, and in the 4th display area 14 the discharge spot is sustained in the phase D—D . . . . In this case, the write drive 90 is connected in common to the corresponding write electrodes of the 1st and 2nd display areas, as shown in FIG. 6. In the half-selected area under the sway shift condition, the write discharge is generated by the activation timing of the phase D, but such discharge disappears in the successive backward shift operation, and the discharge spot thus written at the bottom of the 2nd half-selected display area is erased.

Then, when the forward shift operation mode is selected for the 2nd display area, the operating condition must be set by keying in new data according to the above-mentioned operation. Namely, the output condition of the flip-flop 531 is changed in response to the write command signal STB which is generated by the data keyed in and thereby said logic signal LGS1 becomes "0", while LGS2 becomes "1".

Thus, the 3rd bit output of the decoders (616, for example) becomes "1" and the corresponding AND gates (613, for example) open the gate. As a result, the basic pulse trains are supplied to the shift drive circuit in the relation shown in FIG. 7 for the above-mentioned operation, and therefore the 2nd display area 12 performs a forward shift operation of the discharge spots written in during the activation timing of phase D, while the 1st and 4th display areas 11, 14 perform the sway shift operation, and the 3rd display area 13 performs stationary display operation.

When it is necessary to roll up the data displayed in the 1st and 2nd display areas by the above selective shift operation to the 3rd and 4th display areas respectively, both said logic signals LGS1 and LGS2 become "1" on the basis of the roll up command signal RUS which is generated as a result of the operator keyboard input, and thereby the 4th bit output of the decoders (616, for example) becomes "1". Thus, corresponding AND gates (614, for example) open the gates, and as a result the basic pulse trains sent from the corresponding circuit blocks 42-1 to 42-4 of the timing selection circuit 40 are supplied to the shift drive circuit via the AND gates and corresponding OR gates (611 and 615, for example) in the relation shown in FIG. 7. As a result, as mentioned above, all display areas are set in the forward shift operation mode, and the data in the 1st and 2nd display areas are shifted or rolled up into the upper 3rd and 4th display areas.

As is apparent from the above explanation, according to the self shift PDP and the driving system of the present invention, the display function is significantly improved by the employment of the partial selective shift operation, but a problem arises from having divided the display screen into plural display areas.

The above-mentioned driving system has a configuration in which the discharge spots of to an input character are generated by driving the write drive circuit in units of one character for the corresponding write discharge cells of the display area to which data is to be written and then shifted into the relevant display area. Thus, when writing different characters into plural display areas alternately in a display panel which is composed of many divided display areas, a large time deviation is generated in the data writing period between the first data writing display area and the last data writing display area. In short, since character data is not displayed simultaneously in all display areas, it is very difficult for the operator to read such content that is written with this large time difference. This problem occurs especially when the characters already displayed in each of the lower display areas are rolled up to a corresponding upper display area simultaneously with such data writing operation.

In order to solve this problem, the present invention includes a unique proposal. The input data may be concurrently displayed in each display area in which data to be written is input in units of one picture element, that is, dot by dot, by alternately selecting a pair of display areas and corresponding write discharge cells.

ring, but this writing into the 1st area is automatically erased. The writing occurs during the backward step of the sway shift operation, so the discharge spot is shifted to the outside of the panel as described in relation with FIGS. 3 and 4. Thus, the characters read out from each of the display area memories 100A, 100B become visible simultaneously in the 1st and 2nd display areas 11 and 12 (actually there is a small timing difference corresponding to the time required for writing each picture element).

However, the character data stored in the rows after the 1st row in the display area memory are subject to the roll up operation in addition to the write operation, and therefore the following write operation is performed. Namely, for example, the left display screen is considered to be selected, and the character data of, for example, the 2nd row is written as one row of picture elements in the 1st display area 11, and the picture elements of the characters of the 1st row which have been displayed in the 1st display area 11 are rolled up to the 3rd display area 13. By repetition of this selective write shift operation for each picture element, the character data stored in both display area memories 100A, 100B may be displayed simultaneously in each of the display areas.

Figure 8:
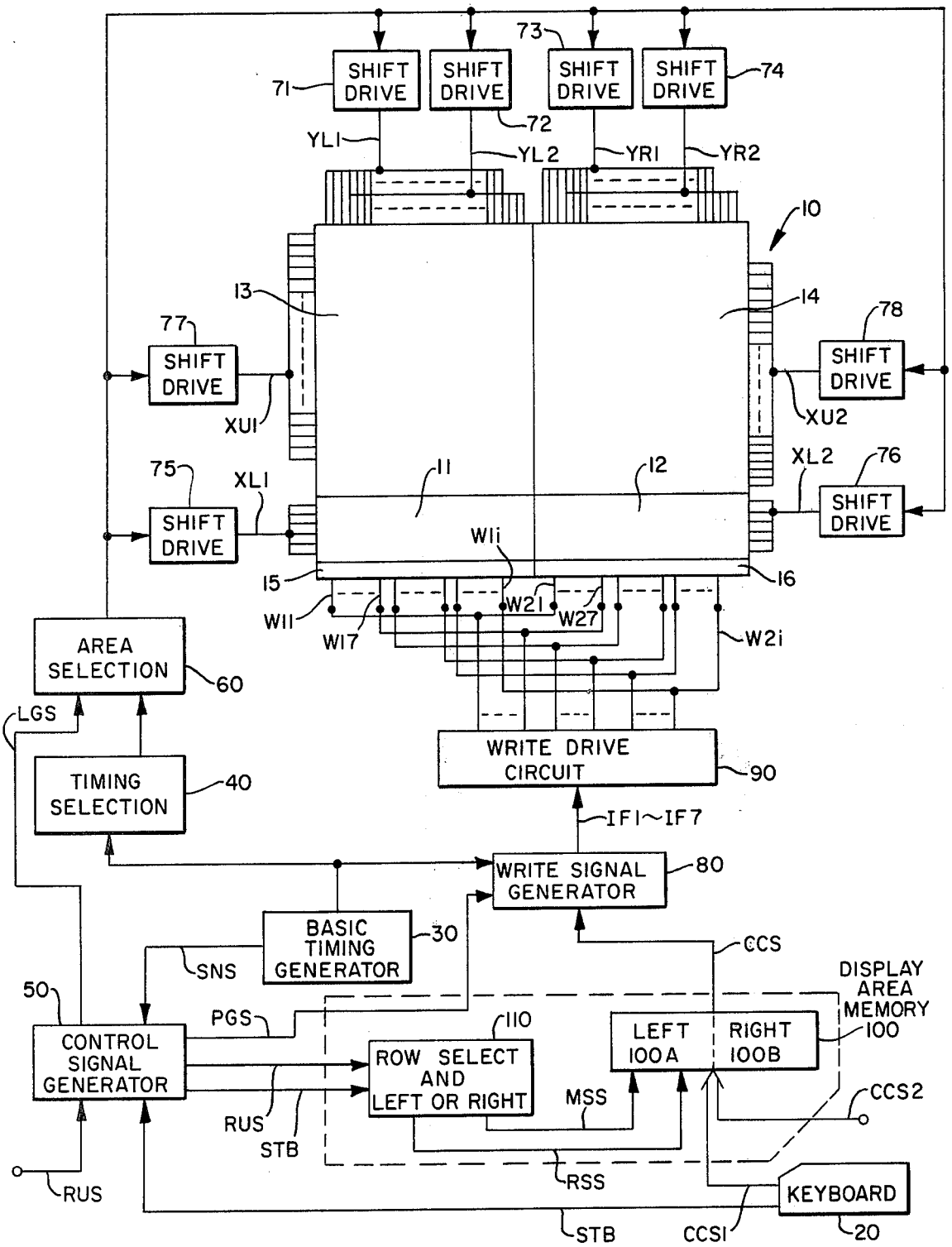
FIG. 8 shows another embodiment of the driving system in accordance with the present invention.
Figure 10:
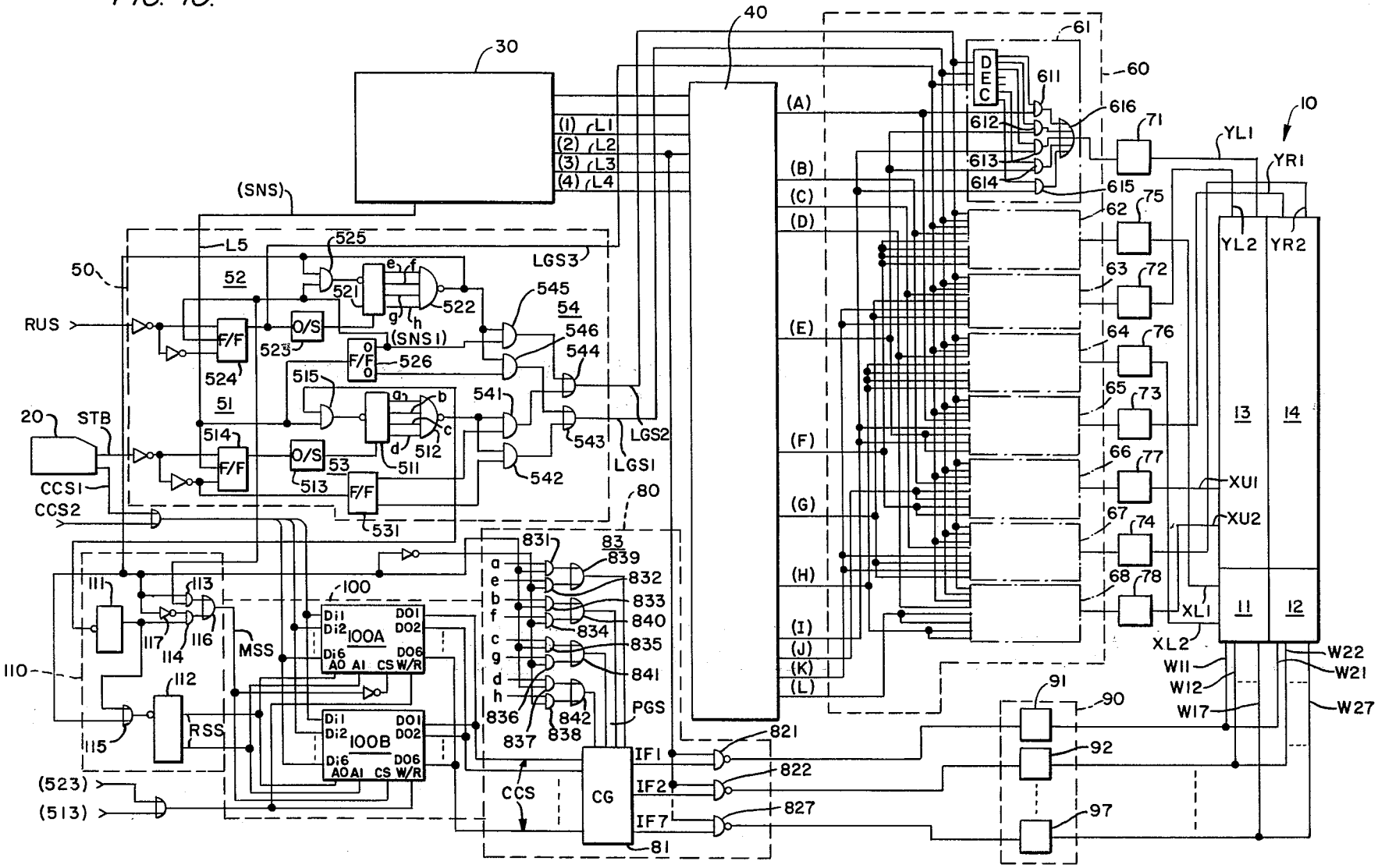
FIG. 10 shows another embodiment of the driving circuit in accordance with the present invention.

FIG. 10 shows the details of an embodiment conforming to the block diagram of FIG. 8. The basic timing signal generator circuit 30 and the timing selection circuit 40 have the same configuration as those shown in FIG. 6. The control signal generator circuit 50 is different from that explained in relation with FIG. 6 only in the roll up control command circuit 52 and the operation selection control circuit 54. Thus, explanation will be given only for these circuits here. Namely, in the roll up control command circuit 52, the flip-flop circuit 526 is newly added, and the inputs to the one input terminal of the AND gate 525 and to the clock terminal of the flip-flop circuit 524 are modified. Specifically, the flip-flop 526 enables a shift operation for every picture element alternately for the 1st and 2nd display areas during the roll-up operation. This circuit receives as an input the shift operation number signal SNS and alternately generates the logic output "1" from the two output terminals. The AND gate 525 has as an input one output SNS1 of this flip-flop circuit 526 and supplies it for two picture elements, namely in every 2 shift operations, to the 4-bit counter 521. Therefore, the NAND gate 522 generates the shift operation command output "1" while 32 shift operation number signals SNS are output. Also, the signal SNS1 is input to the clock terminal of the flip-flop 524.

In the operation selection control circuit 54, a pair of AND gates 545 and 546 for the command output of shift operation for roll up are newly added. One input of these AND gates is connected to the output terminal of the NAND gate 522, while the other inputs are connected to each output terminal of the flip-flop 526. When the AND gate 545 generates logic output "1", the 1st display area 11 is selected, and while the AND gate 546 generates the logical output "1", the 2nd display area 12 is selected.

The area selection circuit 60 is modified to a large extent as explained next for each circuit block, circuit 61 being typical. This circuit is composed of five AND gates 611 to 615, the OR gate 616 and the 7-line decoder 617 for decoding three logic signals LGS1 to LGS3 sent from the control signal generator citcuit 50. The 1-, 2-, 3-, 6- and 7-line outputs of the decoder 617 comprise respectively one input to the AND gates while the other inputs are the respectively connected outputs from the timing selector circuit 40. The outputs of the OR gates which receive the outputs of the AND gates are connected to the shift drive circuits 71 to 78.

As shown in FIG. 10, the display area memory 100 comprises the 1st display area memory 100A and the 2nd display area memory 100B which correspond to the left and right areas of the display screen. These memories are not limited to any particular configuration, but may each have a memory capacity of 4 rows, and for this purpose the 2-bit address terminals A0 and A1 are provided. These memories are further provided with the display screen selection terminal Cs and the write/-read terminals W/R, and thereby the desired display area memory can be subject to selective write and read operations by means of the display screen selection signal MSS, which is described below, and by the outputs of the write command circuit 51 and the monostable circuits 513 and 523 of the roll up command circuit 52. These memories are furthermore provided with the data input terminals Di1 to Di6 for inputing the character code signals CCS1 and CCS2 of the 6-bit configuration sent from the keyboard 20 and the computer, and the 6-bit data output terminals D01 to D06.

The row selection control circuit 110 is provided for automatically performing line feed and selection of the display area memory, either when writing a single character or when writing characters of plural rows, which were first stored in the display area memory 100 after inputing at the keyboard 20. This circuit 110 comprises the binary counter 111, the 4-step counter 112, AND gates 113, 114 and OR gates 115 and 116. The binary counter 111 is used for counting the number of input characters, which counts in response to the falling edge of the output (pulses) from the NAND gate 512 of the write command circuit 51.

The 4-step counter 112 is provided for counting the number of rows. This counter is connected to the output terminals of the binary counter 111 via the OR gate 115 and the output terminal of NAND gate 522 of the roll up command circuit 52, and this counter 112 counts selectively these outputs. This counted output is used as the row selection signal RSS. A pair of AND gates 113 and 114 and the OR gate 116 are provided for the display area memory. The AND gate 113 is connected to each of the output terminals of the NAND gate 522 and the flip-flop 526 of the roll-up command circuit 52 to generate the logic output "1" when the roll-up command is issued. The AND gate 114 is connected to the output terminals of the inverter 117 for inverting the output of the NAND gate 522 and to the binary counter 111, and it generates the logic output "1" when ordinary write command is issued. The OR gate 116 outputs the display screen selection signal MSS in the form of the logic outputs of "1" and "0" in response to the outputs of these AND gates. For example, when MSS is "0", the left display area memory 100A is selected, and if MSS is "1" the right display area memory 100B is selected.

In the write signal generator circuit 80, the pattern generation selection circuit 83 is newly added for controlling the write operation for each picture element as the usual write and roll up commands are issued. This pattern generation selection circuit 83 is composed of a 1st group of AND gates 832, 834, 836, 838 which open the gates in order to pass each output of the counter 521 when the roll up command is issued in response to the FIG. 8 shows a block diagram for such a system. When comparing it with that shown in FIG. 1, the new portion of the circuit is enclosed by the dotted line block and some other changes are found in other parts of the circuit. The roll up command signal RUS of the control signal generator circuit 50 is changed so that the left and right areas of the display screen are alternately set to the selective shift operation mode with one picture element being written into each area in sequence. In addition, the distribution sequence of the four basic pulse trains of the area selection circuit 60 is changed so that the roll up operation is alternately and selectively performed once every picture element for the left and right areas of the display screen. As for the circuit changes, the character pattern signals IF1 to IF7 of the write signal generator circuit 80 are generated when a pattern generation selection signal PGS from the control signal source 50 is input in addition to the particular basic pulse train. This pattern generation selection signal PGS corresponds to the shift operation number signal SNS in the ordinary write operation, or to two of the shift operation number signals in the roll up operation period.

As shown in FIG. 8, the newly added display area memory 100 comprises two display area memories 100A, 100B which correspond respectively to the left and right display screens. The memory 100 reads the single character data keyed in simultaneously with the code signal CCS1 of the character in response to the write command signal STB, while it stores the code signal CCS2 for the at least one row of character data sent from the not illustrated computer terminal, and the memory 100 sequentially reads out the data in reply to the roll up command signal RUS. This memory 100 also stores the display screen selection signal MSS which will be explained later and thereby any one of the two memories can function selectively. In the same way, the row selection control circuit 110 selects the left or right display area, the memory 100A or 100B corresponding to the left or right display screen for data writing, and it also selects the row of the selected display area memory. Thus, this circuit selectively inputs the write command signal STB and the roll up command signal RUS, and it generates the display screen selection signal MSS and row selection signal RSS.

When the character "E" is keyed in from the keyboard 20 under the condition that the 1st display area 11 and the left display area memory 100A are selected by the logic signal LGS sent from the control signal generator circuit 50, the following operations are performed for display. FIGS. 9A–E show a typical write operation sequence of a panel having a monitor portion of 1 row with 2 characters and a display portion having a configuration of 2 rows and 4 characters with the display screen being divided into 4 areas. When a character "E" is keyed in, the code signal CCS1 corresponding to the previously selected area memory 100A is simultaneously read out therefrom and the character pattern signals IF1 to IF7 are then supplied to the write drive circuit 90. At this time, the relevant area of the display screen, which we may assume here to be the last display area, is set to the vertical shift operation mode by the Y side shift drive circuits 71, 72 and the X side shift drive circuits 75, 76 corresponding to the 1st display area 11 which is precedingly selected by the area selection circuit 60. Therefore, the seven write electrodes W11 to W17 corresponding to 7 the shift chanels of the area 11 are sequentially selected 9 times by the write drive circuit 90 in synchronization with the shift operation period, so that the character "E" having a 7×9 dot basic character pattern, each dot corresponding to a picture element, is written into the panel as shown in FIGS. 9A and B.

At this time, as described above, the 2nd display area 12 and the 3rd display area 13 are put in the half-selected condition and thereby the precedingly displayed characters "F" and −S" are sustained by the sway shift operation as shown in FIGS. 9A and B. Meanwhile the 4th display area 14 is put in the not-selected condition and the precedingly displayed character "L" is sustained by the stationary display mode as in the case of FIGS. 9A and B.

This selective write operation is almost the same as the write operation described regarding FIG. 1. When the roll up command signal RUS is input to the control signal generator circuit 50 in order to roll up the characters "E" and "F" written in the lower display areas 11 and 12 of the monitor row to the upper display areas 13 and 14, the logic signal LGS indicating this command is output from the control signal generator circuit 50 and is supplied to the area selection circuit 60.

The write end shift operation may be alternated with the roll up operation for each picture element as shown in FIGS. 9D and E. The selection circuit alternately drives during each picture element the shift drive circuits 71, 72, 75, 77 and 73, 74, 76, 78 respectively of the left display areas 11, 13 and the right display areas 12, 14 and then sets alternately in steps of one picture element the relevant display areas 11, 13 and 12, 14 to the vertical shift operation mode. As a result, characters "S", "E" and "L", "F" are alternately shifted upward in alternating steps of one picture element and therefore the characters "E" and "F" of the lower display areas 11, 12 are rolled up to the upper display areas 13, 14 and in these display areas 13 and 14, display of characters "S", "E", "L", "F" appear concurrently in the vertical direction. FIGS. 9C, D and E show this shift operation mode.

When writing plural rows of character data which is first stored in the display area memory 100, the writing operation must be performed for the plural rows in both the right and left display screens. Therefore, the write, shift and roll up operations must be conducted simultaneously. Namely, when writing memory contents for plural rows, the characters of the row already displayed in the 1st and 2nd areas 11, 12 must be rolled up to the upper 3rd and 4th display areas 13, 14. Such operations are conducted as explained below by issuing a roll up command. In other words, the left and right display areas 11, 13 and 12, 14 are set alternately to the vertical shift operation mode in steps of one picture element corresponding to the roll up command signal RUS and the left and right display area memories 100A, 100B are selectively put in the read out operation mode by alternate designation for the desired row in picture element steps by means of the display area selection signal MSS and row selection signal RSS sent from the row selection control circuit 110. As a result, the stored character data of the 1st row in both the display area memories 100A, 100B are written into the corresponding 1st and 2nd display areas 11, 12 by alternately driving the common write driver circuits with the character pattern signal in steps of one picture element. At this time, data which is to be written into the selected 2nd display area is written at the same time into the not-selected 1st display area where the sway shift operation is occur-output of the NAND gate 522 of the roll up command circuit 52, and a 2nd group of AND gates 831, 833, 835 837 which open the gates when no roll up command is issued, namely when an ordinary write command is issued to pass each output of the counter 511 of the write command circuit 51, and the OR gate groups 839 to 842 which pass the outputs of these pairs of AND gates. Then, each output of these OR gates is input to the character generator 81 as the pattern generation selection signal PGS, to generate the selected character pattern signals of 7×9 dots for output on IF1 to IF7.

FIG. 11 shows an example of combining the basic pulse trains into four sequential unit periods (steps) for application to the electrode terminals of each display area, when two rows of character data have been previously stored in the display area memory 100, for display on the self shift PDP. When the operator issues a roll-up command, the flip-flop 524 shown in FIG. 10 responds to the roll-up command signal RUS and generates a logic output signal "1". This signal drives the monostable circuit 523, resetting an output of the counter 521, and also enters the area selection circuit 60 as the logic signal LGS3. At this time, the flip-flop 526 receives the shift operation number signal SNS and outputs a "0" signal from the $\overline{Q}$ output terminal and a "1" signal from the Q output terminal. When the counter 521 resets, the NAND gate 522 outputs a "1" signal, and therefore an output "1" of the $\overline{Q}$ output terminal passes the AND gate 546 and enters the OR gate 543. Then, the logic signals LGS1, LGS2 generated from the OR gates 543, 544 become respectively "1" and "0".

When the three logic signals LGS3, LGS2, LGS1 become respectively "1", "0", "1", the 6th bit output of the decoders (617, for example) in each of the circuit blocks 61 to 68 of the area selection circuit 60 become "1". Thereby, the corresponding AND gates (614, for example) open the OR gates and pass simultaneously in parallel in each step in the relation shown in FIG. 11A the basic pulse trains which are output from the circuit blocks 42-1, 42-2, 42-4 and 41-2 (shown in FIG. 6) of the timing selection circuit 40. The basic pulse trains which have passed these AND gates pass the corresponding OR gates (616, for example) and are supplied in parallel to the corresponding shift drive circuits. As a result, as is apparent from comparison with the electrode waveform in the rotation from step 4 to step 3 in FIG. 4, the 1st and 3rd display areas 11, 13 in the left side are put in the vertical shift operation mode, and the 2nd and 4th display areas 12, 14 in the right side are put in the half-selected condition, respectively.

During such operations, the stored data of the display area memory 100 is input to the write drive circuit 90 in the following way. Because of the output relation of the NAND gate 522 and flip-flop 526, the output of the OR gate 616 corresponding to the display screen selection signal MSS is "0". Therefore, only the left display area memory 100A is put in the operation mode. At this time, the two outputs of the 4-step counter 112 corresponding to the row selection signal RSS are "0" and "0", and this designates the 1st row. Therefore, the stored data in the 1st row of the left display area memory 110A is read out, in the form of the code signal CCS by means of the output of the monostable circuit 523 because the roll-up command signal RUS corresponding to the read signal, and is then supplied to the character generator 81.

At this time, since the counted value of the counter 521 is zero, the logic value of the pattern generation selection signal PGS becomes "0000" and designates the character pattern signal of the 1st row. Thus, the character generator 81 outputs only the 1st line of the 9 lines of picture elements to the write lines IF1 to IF7 according to the character code signal. The output pattern signal of the 1st line passes the NAND gate groups 821 and 827 in synchronization with the generation of the basic pulse train (2) and is then supplied to the corresponding write drive circuits 911 to 917. Thereby, these drive circuits apply the write pulse PW to the selected write electrode as mentioned previously to generate the first discharge spots at the respective write discharge cells. The discharge spots generated at the write discharge cells are shifted in the sequence of A to B to C in accordance with the vertical shift operation mode in the 1st display area 11, and in the 2nd display area 12, the discharge spot is sway-shifted in the sequence of A—A to D, the cell of phase D being in fact the write cell W, by the half-selected operation mode and thereby is erased. Therefore, only stored character data sent from the left display area memory 100A to the 1st display area 11 is written.

When the selective writing and shift operation of the data stored in the left side display area memory is complete, the shift operation number signal SNS is generated, and the output condition of the flip-flop 526 is inverted. Thus, the logic signals LGS1, LGS2 become "0" and "1", respectively. Thus, when the three logic signals LGS3, LGS2, and LGS1 become "1", "1" and "0", respectively, the 7th bit output of the decoders (617, for example) become "1" and the gates of the corresponding AND gates (615, for example) open. As a result, the basic pulse trains sent from the circuit blocks 42-2, 42-3, 42-4 and 41-2 of the timing selection circuit 40 are applied to the shift drive circuit in such a relation as shown in FIG. 11B via these AND gates and the corresponding OR gates (616, for example). Thereby, the 2nd and 4th display areas 12, 14 in the right side are put in the vertical shift operation mode and the 1st and 3rd display areas 11, 13 in the left side are put in the half-selected operation mode. During this operation, when the Q output of the flip-flop 526 becomes "1", the display screen selection signal MSS becomes "1", designating the right display area memory 100B. On the other hand, the row selection signal RSS designates the 1st row as in the case mentioned above. Therefore, the stored character data of the 1st row of the right display area memory 100B is read out and then input to the character generator 81. At this time, since the pattern generation selection signal PGS designates the 1st line also as in the case above, the character pattern signal of the 1st line is supplied to the write drive circuit, as in the above-mentioned operations. As a result, a discharge spot is generated at the corresponding write discharge cell.

This discharge spot is sequentially shifted in the sequence of A to B to C in accordance with the vertical shift operation mode in the 2nd display area 12, and in the 1st display area 11 the discharge spot disappears as mentioned above as a result of the sway shift operation. However, the discharge spot, which has been previously written in the 1st display area 11 and is currently displayed in the discharge cell of phase A spaced by one picture element from the write cell, is sway-shifted in the sequence of D to A—A to D and is thusly sustained in the initial discharge cell of phase D. Therefore, the data of one picture element stored in the right display area memory 100B is written only into the 2nd display area 12.

When the writing operation of one picture element stored in the right display area memory 100B is complete, the shift operation number signal SNS is generated again to invert the output condition of flip-flop 526. Thus, the left display area memory 100A is selected and put into the write/shift operation mode. At this time, the counter 521 performs the counting operation in response to the falling edge of the Q output of the flip-flop 526 and makes the 1st bit output have the value of "1". Thereby, the logic value of the pattern generation selection signal PGS becomes "0001", designating the character pattern of the 2nd line. Therefore, the write operation for the character pattern signal of the 2nd line is conducted.

When the above operations are repeated and the data stored in the 1st row of the right display area memory has been written, line feed is performed automatically by the following operation and the stored data of the 2nd row is written. Since all of the 4-bit outputs of counter 521 become "1" when the writing of one character is complete, the output of the NAND gate 522 becomes "0". Thus, the counter 112 for the line counting of row selection control circuit 110 performs its operation and its logic value becomes "01", so that the row selection signal RSS designates the 2nd row. Thereby, the stored data of the 2nd row is written into the left and right display screens by means of the above-mentioned operation. In this case, the characters of the 1st row which are already displayed in the lower 1st and 2nd display areas 11, 12 are alternately rolled up one picture element at a time by the vertical shift operation mode of the upper 3rd and 4th display areas 13, 14. As a result, while the characters of the 2nd row are written into the lower display areas, the characters of the 1st row which are already displayed in the display area are rolled up to the upper display areas.

As is understood from the above explanation, according to the present invention, an editing operation which is similar to that attained by the well known existing matrix display gas discharge panel can be realized, and as a result the display function can be improved by employing a panel configuration where the display screen, which is composed of a plurality of shift channels arranged vertically, is divided into several sections both in the horizontal and vertical directions. Thereby the shift operation can be made in each display area of the divided display screen. In addition, the operating margin can be increased by employing a driving system in which, while the data is written into the selected display area and is being shifted, the displayed data is sustained in the half-selected display area by the sway shift operation, and simultaneously in the not-selected display area the display data is sustained in the stationary display mode. When writing character data for plural display areas, the character data to be written are written one picture element at a time by alternately selecting a pair of vertical display areas in plural groups and corresponding write discharge cells. Thus the input characters can be displayed almost at the same time in each display area, which makes the display contents very easy to read. This is very convenient for the operator. The subject mater of the present invention is not restricted to the above-mentioned embodiments, but can be modified and expanded in various forms.

For example, a double cell activation system is possible to obtain high display intensity. Two adjacent discharge cells may be activated, instead of the above-mentioned single cell activation system. FIGS. 12A through H show the driving voltage waveforms for such a double cell activation mode. In this figure, the 1st display area 11 is selected, the 2nd and 3rd display areas 12, 13 are half-selected and the 4th display area 14 is not-selected. During the unit period T0, the write pulse EP is applied simultaneously to the write electrodes W11 to W17, and W21 to W27, and the resulting write voltage waveforms shown in the figure are applied to the write discharge cells. During this first step T0, the shift pulse SP is applied to the phase A discharge cell aj of the shift channels SC1j and SC2j (j=1, 2, 3 . . . ), and the discharge spot is simultaneously generated at the first discharge cell a1 adjacent to the write discharge cell by means of the preconditioning or firing effect of the already written discharge spot. The discharge spot generated at the discharge cell a1 is shifted during the next unit period T1 to the two adjacent discharge cells a1, b1 of phases A and B in accordance with cycling of the basic pulse trains. Then, these discharge spots, in the case of the selected 1st display area 11, are shifted sequentially in the next unit periods T2, T3 to the other end of the shift channel SC1j with two adjacent discharge cells b1, c1 and c1, d1 being in a common discharge state by application of the basic pulse trains shown in FIG. 12A. During this period, the erase pulse EP is supplied as a result of pulses with a phase difference being applied to respective opposing electrodes. Thus, the erase operation of the relevant discharge spot is performed, according to the shift operation mode shown in FIG. 13A.

Figure 13A:
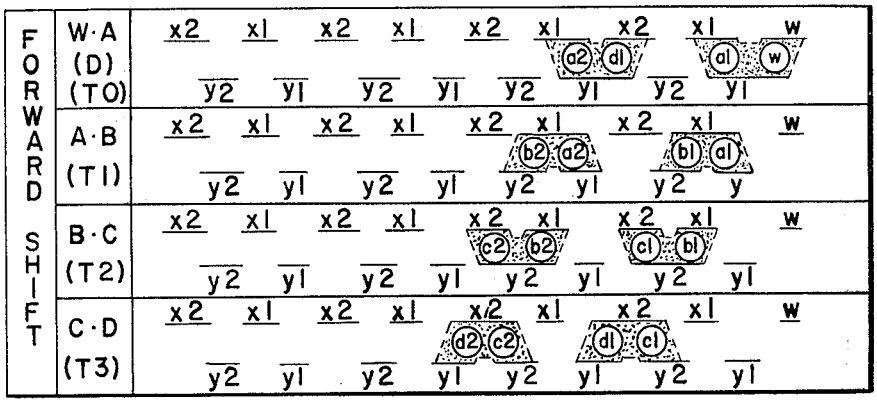
FIGS. 13A to D show another operating mode for shifting discharge spots in each display area in accordance with the driving voltage waveforms of FIGS. 12A to H.
Figure 13B:
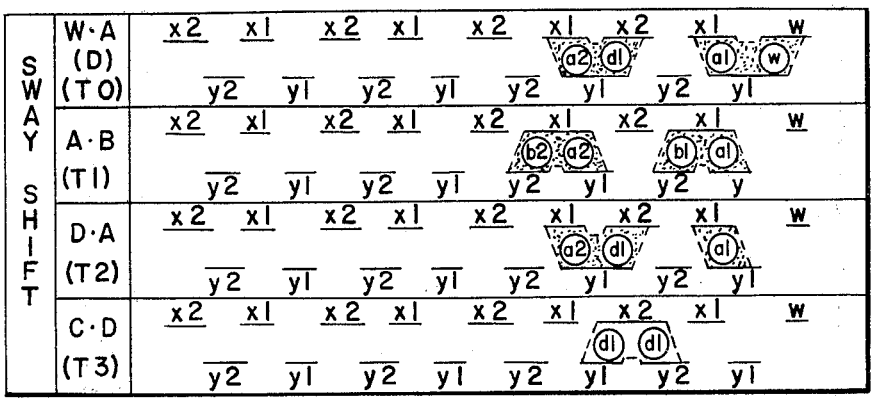

In the half-selected 2nd display area 12, the basic pulse train applied to the Y side bus is selected in the next unit period T2 in the reverse relation to that of the selected area 11, and the discharge spots located at the discharge cells a1 and b1 are returned again to the discharge cells a1 and d1 of phases D and A. In the next unit period T3, the discharge cells of phase D and phase C are activated as for the selected area, and in the half-selected area the discharge spot is shifted backward from the discharge cells of phases D and A to the adjacent discharge cells of phases D and C. For the sway shift operation, the write discharge spot, which was generated in the selected area by the write operation, is erased in this period when the erase pulse EP is applied to the cell a1. If previously written discharge spots exist at the discharge cells d1 and a2 of this half-selected area, these discharge spots in two adjacent cells are sustained by vibrating to the left and right in the sequence of a2.b2 to a2.b1 to d1.c1 by the application of the pulse trains in accordance with the above-mentioned sway shift operation mode. FIG. 13B shows an example of such a sway shift operation mode.

Figure 12A:
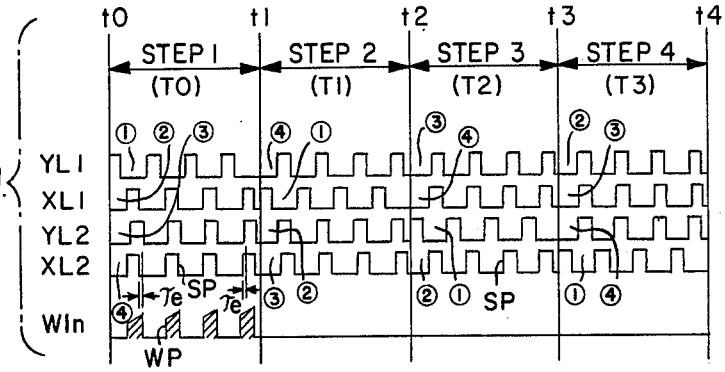
FIGS. 12A to H show another example of the driving voltage waveforms for the driving circuit of the present invention.
Figure 12B:
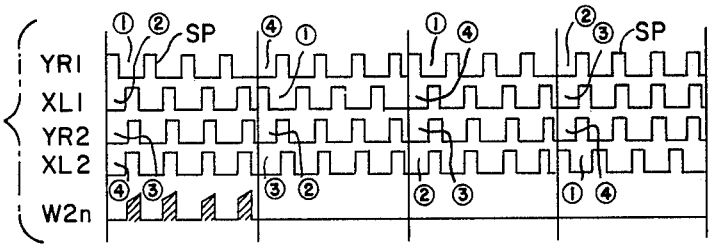
Figure 12E:
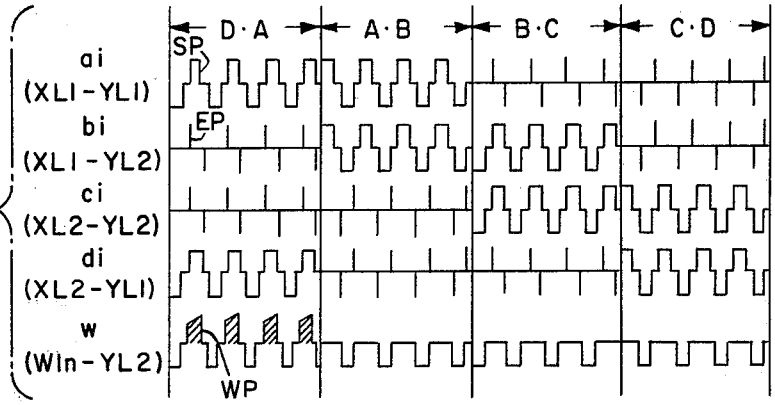
Figure 12F:
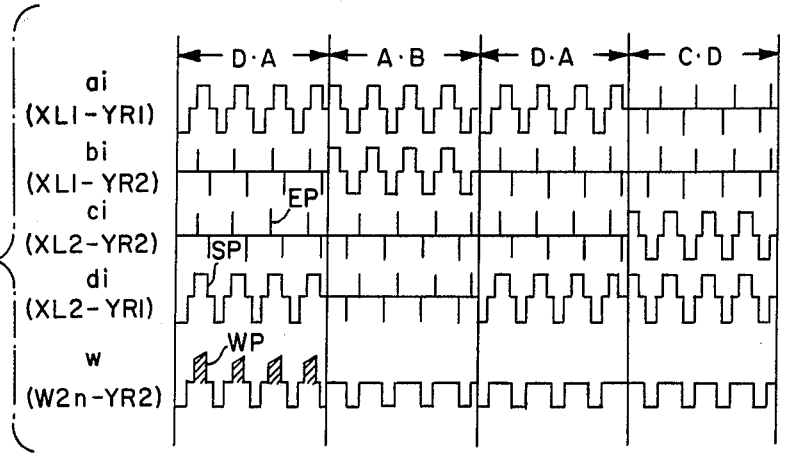
Figure 12C:
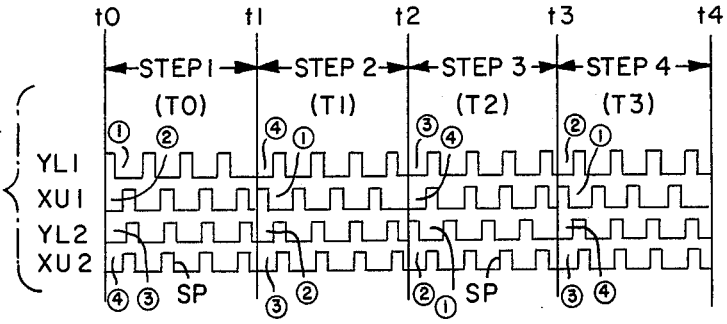
Figure 12D:
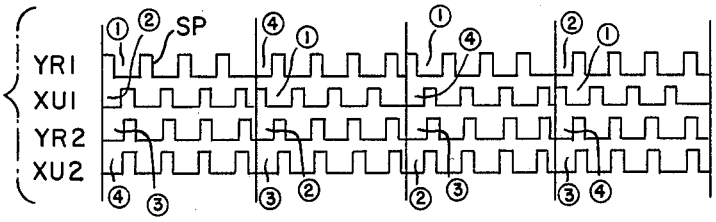
Figure 12G:
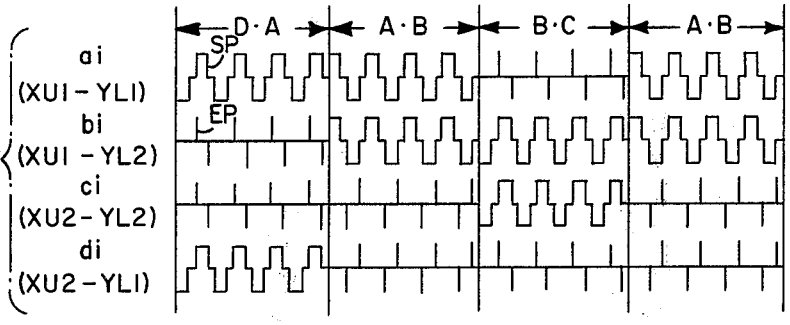
Figure 12H:
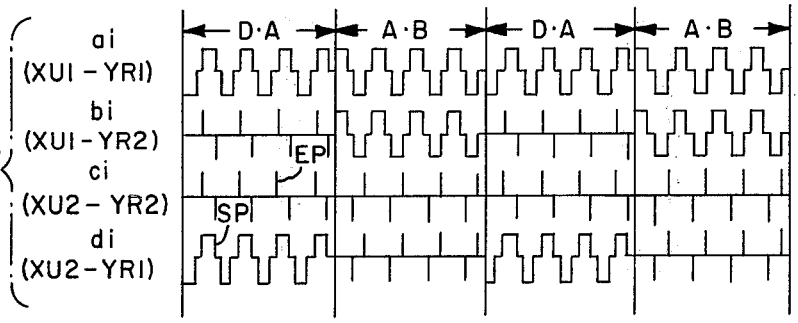
Figure 13C:
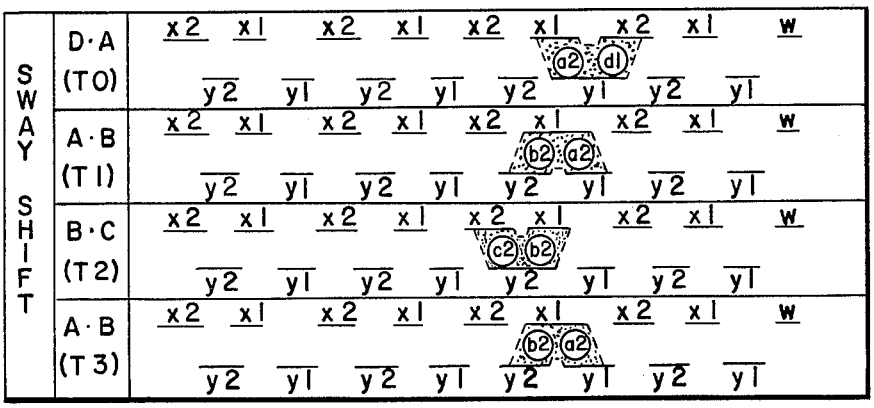
Figure 13D:
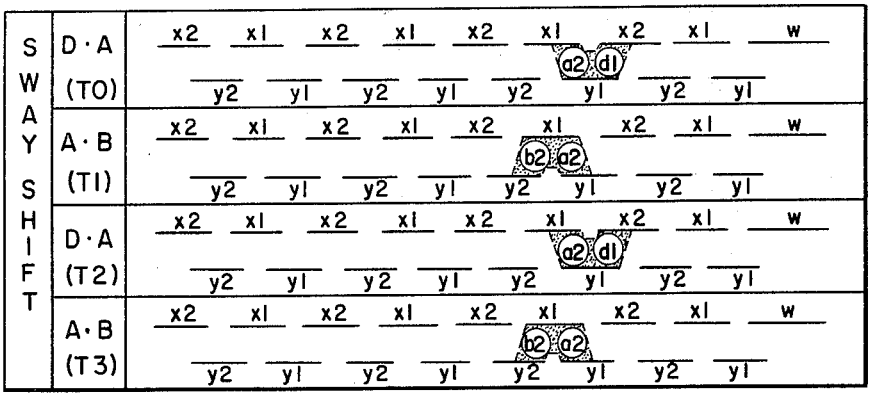

For the 3rd display area 13 in the half-selected operation mode, the sway shift operation is shown in FIG. 13C for the driving voltages shown in FIGS. 12C and G. In the 4th display area 14 having the not-selected operation mode, the sway shift operation as shown in FIG. 13D is carried out by means of the driving voltages as shown in FIGS. 12D and H. This double cell activation system ensures a high display intensity in each display area and increases the operation margin of the display area which is in the not-selected condition.

According to another modification of this invention, the present invention can be applied in the same way as described above to various kinds of self shift PDPs having the above-mentioned matrix or cross-electrode configuration, a parallel electrode configuration or a meander channel configuration. As a further variation, a selective partial erasing system can be employed wherein the erasing operation is made individually in each display area in order to prevent overlap of the display data at the boundary between the upper and lower display areas. Namely, the above-mentioned embodiment has the disadvantage that faulty display may occur during data writing because while data is being written into the 1st display area 11, the displayed data are sustained at the current location in the 3rd display area 13 located above the 1st area by means of the sway shift operation.

Thus, when writing additional new data into the 1st display area 11 in which data have already been written and which are being displayed in the display areas 11, 13, the area 11 must be set to the shift operation mode in order to bring the discharge spots representing this new data into the desired data position. Therefore, the discharge spots corresponding to the old displayed data in the area 11 are also shifted in the forward direction as explained above. Thus, the discharge spots of this old display data are shifted into the 3rd display area 13, as a result of shifting the discharge spots related to the new data.

This results in overlap with the discharge spots corresponding to the displayed data in the relevant area 13. This overlap occurs only at the boundary of the display areas 11 and 13, since the 3rd display area 13 is in the sway shift operation mode. This may induce a display of faulty data. To eliminate this, a selective partial erasing system may be employed. Briefly speaking, in this selective partial erasing system, a shift or sustain pulse may be used in preparation for selective erasing. This is applied to one of the Y (or X side) electrodes in the display area selected for erasing data, and thereafter a narrow erase pulse is applied to the opposing X side (or Y side) electrode. Thereby, the displayed data of the relevant display area can be erased.

Figure 14A:
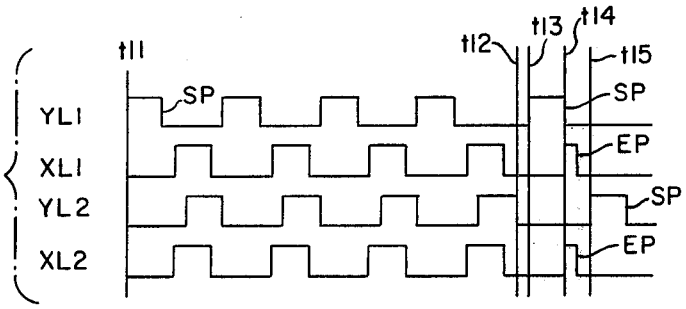
FIGS. 14A to H show a further example of driving voltage waveforms for a driving circuit of the present invention.
Figure 14B:
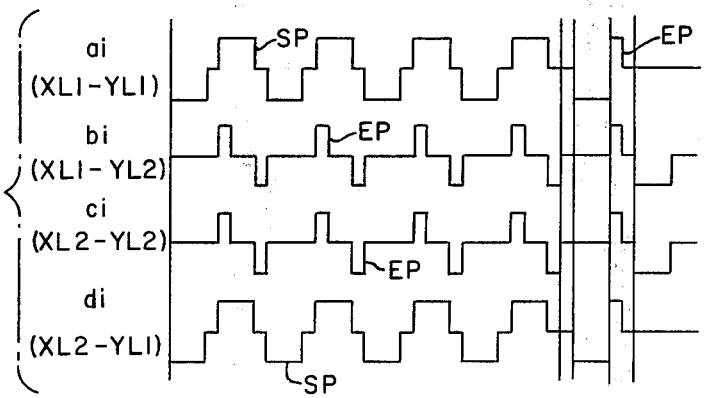

FIGS. 14A to H show driving voltage waveforms which enable such a selective partial erasing operation. The 1st display area 11 is switched to the erasing operation mode from the display mode. Since all display areas are in the display condition at the timing t11 to t12, a driving voltage which is the same as the voltage waveforms in step 1 of FIG. 11 is applied to the electrode terminals of each display area. Therefore, all display areas 11 to 14 display the data because the discharge cells of phases D and A are activated. However, when the shift or sustain pulse SP is applied in the next timing t13 to the Y side terminal YL1 of the 1st display area 11, as shown in FIG. 14A, to erase the display data of the 1st display area 11, the two activated discharge cells in the relevant area discharge since the cell voltage waveforms as shown in FIG. 14B is applied to them, and thereby the wall charge state is inverted. Therefore, when the narrow erase pulse EP is applied to the X side terminals XL1, XL2 at the timing t14 where this shift pulse rises, said two activated dischage cells discharge once but do not form a wall charge. As a result, this discharge spot is erased and disappears. In the following timing t15, the shift pulse SP is applied to the other Y side terminal YL2, but discharge does not occur since the voltage level does not exceed the discharge start voltage level. Therefore, display data in the 1st display area is erased.

Figure 14C:
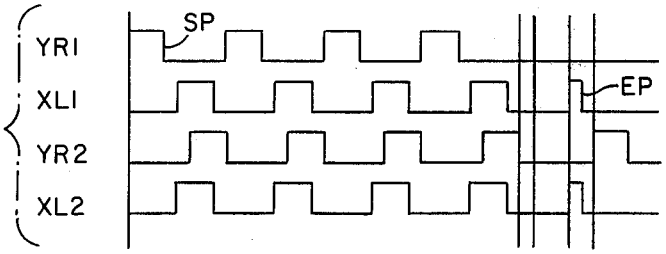
Figures 14D, 14E, 14F, 14G, 14H:
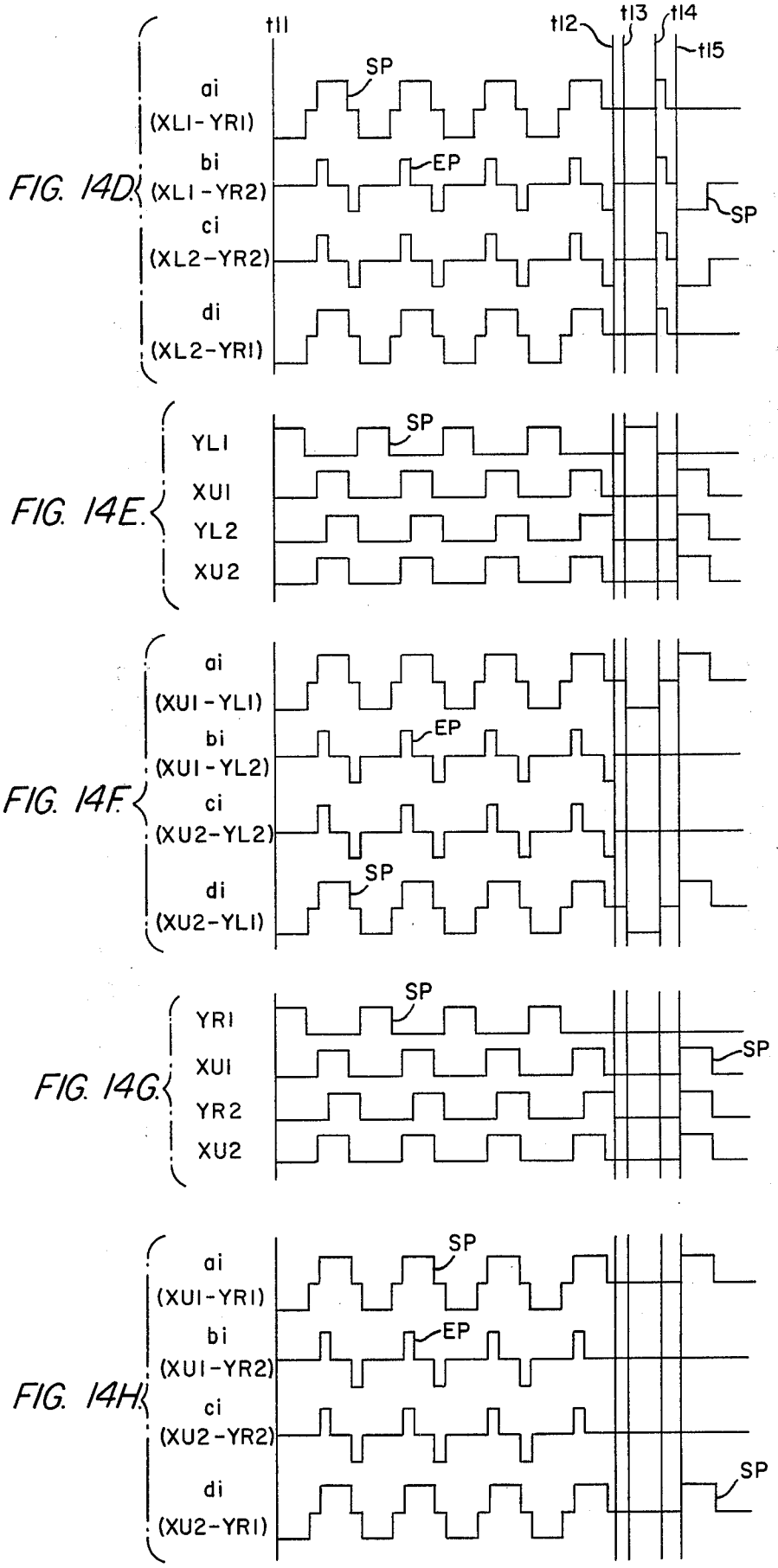

While this erasing operation is performed in the 1st display area 11, in the half-selected 2nd display area, as shown in FIG. 14C, the erase pulse EP is applied to the X side terminals XL1, XL2, but since the polarity of this erase pulse is the same as that of the preceeding shift pulse, as is clear from the cell voltage waveforms shown in FIG. 14D, such an erase pulse does not have any influence of the two discharge cells activated in the relevant display area 12. As a result, the discharge spots are sustained. In the half-selected 3rd display area 13, only the shift pulse SP as shown in FIG. 14E is applied to the electrode terminals. Thereby, a voltage as shown in FIG. 14F is applied to the two activated discharge cells so that the discharge spots in these cells are sustained. In the not-selected 4th display area 14, only the shift pulses SP as shown in FIGS. 14G and H are applied so that as in the case of the half-selected display areas 12, 13 the discharge spots of the two activated discharge cells are sustained. Thus, according to this selective partial erasing system, the displayed data is erased only at the selected 1st display area 11, and the displayed data can be sustained in the remaining 2nd to 4th display areas 12 to 14. Therefore, overlap of data at the boundary between vertically adjacent display areas can be prevented. Here, there is no need of synchronizing the timing of the erase pulses EP to the rising edge of the shift pulse SP as mentioned above, so that it can be set to the desired timing after generation of the pulse.

As explained above, the self shift type gas discharge panel and the system and method for driving the same conforming to the present invention can drastically improve the display functions and operability of the self shift type gas discharge panel. Thus, it is possible to expect a significant impact when the present invention is adapted to a monitor display for the terminal of a computer system.

What is claimed is:

1. A self shift type of gas discharge display system, comprising a discharge panel having at least four panel areas selectively aligned in rows and columns, wherein each of said four panel areas has two sides adjacent to respective sides of two others of said four panel areas, and two of said panel areas, corresponding to a first one of said rows of said panel areas, each have one side adjacent a first edge of said display panel, a plurality of sets of shift channels, each said shift channel comprising a line of discharge cells defined by respective portions of electrodes separated by a discharge gap, and all the shift channels of each said set extending across all the panel areas of a respective one of said columns of panel areas, a plurality of write cells, each said write cell being located at one end of a respective one of said shift channels along said first edge of said panel, for writing discharge spots into said shift channels, said electrodes of said shift channels being divided into first and second plural sets of plural groups, all the electrodes in each said group being electrically connected in common, each said first set of groups including electrodes in all the panel areas of a respective one of said rows of panel areas, and each said second set of groups including electrodes in all the panel areas of a respective one of said columns of panel areas, each said group of electrodes including electrodes from all the panel areas of the respective row or column of said panel areas, said system comprising operating means for applying respective waveforms to each said group of electrodes and to said write electrodes, for writing and shifting selected display data in the form of said discharge spots into said discharge cells of selected panel areas of said first row of panel areas, while displaying previously-written display data in other ones of said panel areas.

2. The system of claim 1, each adjacent pair of said discharge cells along each said shift channel being electrically coupled as a result of the configuration of said electrodes.

3. The system of claim 1, comprising said display panel having two sides separated by said discharge gap, each said first set of said plural groups of electrodes including a respective pair of said groups of electrodes that are located on a first side of said panel, each said second set of said plural groups of electrodes including a respective pair of said groups of electrodes that are located on the other side of said panel.

4. The system of claim 3, comprising said electrodes of said shift channels having configurations including portions extending between adjacent discharge cells in each said shift channel.

5. The system of claim 4, said operating means including means for shifting a predetermined number of said selected display data successively into each said selected panel area, and for shifting said selected display data from each said selected panel area into a selected panel area along the respective column of panel areas, prior to writing and shifting said selected display data into another one of said selected panel areas adjacent said first panel edge.

6. The system of claim 4, said operating means including means for successively writing and shifting a predetermined number of said selected display data into a selected succession of said selected panel areas adjacent said first panel edge, while simultaneously displaying said previously written display data in the other panel areas besides each instantaneously selected panel area, and for simultaneously shifting the previously written display data from the panel areas adjacent said first panel edge into the panel areas in the respective columns of panel areas.

7. The system of claim 6, said operating means comprising a display area memory for each said panel area adjacent said first panel edge, and selectively operable input means for inputting said selected display data to said display area memory to be written and shifted into each said panel area adjacent said first panel edge.

8. The system of claim 4, said other panel areas of said display panel including half-selected not-selected panel areas, each said half-selected panel area having one of said sets of groups of electrodes in common with said selected panel areas, and each said not-selected panel area having none of said groups of electrodes in common with said selected panel areas, said operating means comprising means for said displaying of said previously written data in said other panel areas, while said data is simultaneously written and shifted in said selected panel area adjacent said first panel edge, wherein said previously written display data is sway-shifted in each said half-selected panel area, between respective discharge cells and the two adjoining discharge cells on each side of each said respective discharge cell, and each said previously written display data is stationarily displayed at a respective discharge cell in each said not-selected panel area.

9. The system of claim 4, said other panel areas of said display panel including half-selected and not-selected panel areas, each said half-selected panel area having one of said sets of groups of electrodes in common with said selected panel areas, and each said not-selected panel areas having none of said groups of electrodes in common with said selected panel areas, said operating means including means for displaying said previously written display data in said other panel areas, while said selected display data is simultaneously written and shifted in each said selected panel area, wherein each said display data in each said panel area is represented by discharges in two adjacent discharge cells along the respective shift channel, each said previously written display data in each said half-selected panel area is shifted between adjacent pairs of four successive ones of said discharge cells of the respective shift channels, and each said previously written display data in each said not-selected panel area is shifted between adjacent pairs of three successive ones of said discharge cells of the respective shift channels.

10. The system of claim 1, 3, 5, 6, 8, or 9, said operating means including means for applying selected sequences of four different basic waveforms to respective ones of said groups of electrodes for providing said writing, shifting and displaying of said display data.

11. The system of claim 10, wherein each said selected area corresponds to at least one character for said display panel, all of said areas adjacent said first edge comprising a monitor row for display of said selected display data for verification prior to said shifting thereof into the other ones of said panel areas in said columns of panel areas.

12. The system of claim 1, 3, 5, 6, 8 or 9, said operating means comprising means for writing said shifting said selected display data into each said selected panel area adjacent said first panel edge, wherein corresponding write electrodes of each of said panel areas adjacent said first panel edge are connected in common so that the same selected display data is written into all the respective shift channels having the commonly connected write electrodes, and said selected display data that is written into the corresponding shift channels of said other panel areas adjacent said first panel edge are effectively erased as a part of said display of said previously written data in each of said other panel area along said first edge of said display panel.

13. The system of claim 11, said operating means comprising means for writing and shifting said selected display data into each shift channel of each said selected panel area adjacent said first panel edge, wherein corresponding write electrodes of each of said panel areas adjacent said first panel edge are connected in common so that the same selected display data is written into all the respective shift channels having the commonly connected write electrodes, and said selected display data that is written into the corresponding shift channels of said other panel areas adjacent said first panel edge are effectively erased as a part of said display of said previously written data in each said other panel area along said first edge of said display panel.

14. The system of claim 1, 8 or 9, each of said electrodes that is located within the periphery of said discharge panel having two of said respective portions corresponding to two of said discharge cells along each respective shift channel.

15. The system of claim 10, all of said basic waveforms being formed of the same pair of high and low voltage levels.

16. The system of claim 1, 3, 5, 6, 8 or 9, comprising means for erasing any of said previously written display data in each said selected panel area adjacent said first edge of said display panel, prior to said writing and shifting of said selected display data into each said selected panel area.

* * * * *

UNITED STATES PATENT AND TRADEMARK OFFICE

CERTIFICATE OF CORRECTION

PATENT NO. : 4,426,646

DATED : January 17, 1984

INVENTOR(S) : Yamaguchi et al.

It is certified that error appears in the above-identified patent and that said Letters Patent is hereby corrected as shown below:

Col. 2, line 44, "having" should be --adjacent to--.

Col. 4, line 60, "shaft" should be --shift--.

Col. 5, line 34, "rows" should be --row--.

Col. 8, line 8, "53" should be --5B--.

Col. 9, line 51, "and" should be --the--.

Col. 10, line 4, "whichalternately" should be --which alternately--.

Col. 12, line 45, delete "to".

Col. 14, line 9, "-S"" should be --"S"--.

Col. 17, line 24, "$\bar{Q}$" should be --Q--;

Col. 17, line 25, "Q" should be --$\bar{Q}$--;

Col. 17, line 46, "form" should be --forms--;

UNITED STATES PATENT AND TRADEMARK OFFICE

CERTIFICATE OF CORRECTION

PATENT NO. : 4,426,646

DATED : January 17, 1984

INVENTOR(S) : Yamaguchi et al.

It is certified that error appears in the above-identified patent and that said Letters Patent is hereby corrected as shown below:

Col. 17, line 62, "110A" should be --100A--.

Col. 19, line 64, "mater" should be --matter--.

Col. 22, line 6, "of" should be --on--.

Claim 12, line 2, "said" should be --and--.

Signed and Sealed this

*Twenty-fifth* Day of *December 1984*

[SEAL]

*Attest:*

*Attesting Officer*

GERALD J. MOSSINGHOFF

*Commissioner of Patents and Trademarks*